US007494196B2

(12) United States Patent
Franco

(10) Patent No.: US 7,494,196 B2
(45) Date of Patent: Feb. 24, 2009

(54) SYSTEM OF ULTRA LIGHT-WEIGHT DEMOUNTABLE STATIONS

(75) Inventor: Carlos Alberto Leyva Franco, Bogota (CO)

(73) Assignee: Globotech Displays De Colombia, Bogota D.C. (CO)

( * ) Notice: Subject to any disclaimer, the term of this patent is extended or adjusted under 35 U.S.C. 154(b) by 568 days.

(21) Appl. No.: 10/518,476

(22) PCT Filed: May 29, 2003

(86) PCT No.: PCT/IB03/02837

§ 371 (c)(1),
(2), (4) Date: Jul. 12, 2005

(87) PCT Pub. No.: WO04/000077

PCT Pub. Date: Dec. 31, 2003

(65) Prior Publication Data

US 2005/0242050 A1 Nov. 3, 2005

(30) Foreign Application Priority Data

Jun. 25, 2002 (CO) ..... 02-054774

(51) Int. Cl.
*A47B 47/00* (2006.01)

(52) U.S. Cl. ..... 312/257.1; 312/297

(58) Field of Classification Search ..... 312/257.1, 312/107, 108, 198, 3, 4, 5, 6, 297, 140.2
See application file for complete search history.

(56) References Cited

U.S. PATENT DOCUMENTS 3,472,571 A * 10/1969 Himelreich ..... 312/259
3,479,102 A * 11/1969 Wallach et al. ..... 312/195
4,883,331 A * 11/1989 Mengel ..... 312/195
4,926,609 A 5/1990 Arico
5,069,466 A * 12/1991 Propst ..... 280/79.3
5,255,970 A * 10/1993 Theosabrata ..... 312/297
5,402,738 A * 4/1995 Carr et al. ..... 108/157.1
5,542,554 A 8/1996 Resnick
5,597,114 A 1/1997 Kramedjian et al.
6,027,188 A 2/2000 Nickens
6,382,433 B1 5/2002 Podergois
2005/0022703 A1 2/2005 Wintermute, II et al.
2005/0023418 A1 2/2005 Kim

FOREIGN PATENT DOCUMENTS

CA 2 432 406 6/2003
EP 0 900 538 A 3/1999

* cited by examiner

*Primary Examiner*—James O Hansen
(74) *Attorney, Agent, or Firm*—Finnegan, Henderson, Farabow, Garrett & Dunner LLP

(57) ABSTRACT

The system of ultra light-weight demountable stations, for exhibiting articles and attending customers, according to the present invention, comprises at least one universal module (10) of the system, with elliptical cross section, easily assembling, without mechanical elements of nailing, and with great strength. Said universal module, can be optionally joined to a connector module (17) which allows the union of two or more universal modules in a curve or straight shape or in three or more ways. The universal module or the connector module can be also optionally joined to a wing module (11), or to a multiple exhibition applications. All these components of the system act as basic pieces for creating a plurality of exhibition stations, which can be growing in the horizontal and/or vertical direction.

31 Claims, 52 Drawing Sheets

SYSTEM OF ULTRA LIGHT-WEIGHT DEMOUNTABLE STATIONS

FIELD OF THE INVENTION

The present invention is related to a dismountable ultra light stations system to exhibit commercial items and attend customers, according to which finished station structure to exhibit is supplied so that no interlocking mechanical elements participate during its construction, so that parts of each station may be assembled and dismounted manually, without the need to use special tools. According to the system of the invention, it can be constructed exhibit stations and attend customers including a number of individual universal modules that may be different or with the same configuration and/or size, so that it is possible to associate in a given station a number of said modules to provide exhibit station of higher surface area, of different and diverse external decorative aspects. In any of their modes, each model of article exhibition station and attend customers, according to the present invention is light, very solid, easy to assemble and dismount to be comfortably piled up, which condition makes transport and storage easy.

BACKGROUND OF THE INVENTION

Exhibitors usually in commercial use have been constituted by a structure, generally metallic, suitable to support horizontally on it a flat board to satisfy basically functions of a table. On that board there are disposed portable exhibitors such as trestles, to exhibit newspapers and magazines. In other way, for support, the commerce has used enlarged metallic structures having slopping support surfaces converging to a central axis, or structures having an upper flat surface directed in circle arc or in ellipsoidal way. Although it can be said that among such designs from the previous art, there are some ones which offer decorative structures, their mechanical characteristics, such as those related to their weight, and specially related to their properties regarding handling operations as those related with their assembling and dismounting, and with their feasibility to be stored and transported, do not result satisfactory at all, mainly because to carry out said operations, it is necessary to keep in mind weight of the structure and also the use of tools. Also, for the user of this type of exhibitors from the previous art, their design is not beyond than that offered by the manufacturer, impeding him to "create" new arrangements and configuration of exhibitor, than under criteria of the user, would highlight more his product to exhibit, and to be more attractive for the public.

SUMMARY OF THE INVENTION

Keeping in mind the previous description, a purpose of the present invention consists on providing a dismountable, ultra light stations system to exhibit commercial products and attend customers surpassing above mentioned disadvantages.

According to the present invention, here it is supplied a dismountable, ultra light stations system to exhibit items and attend customers, comprising:

- at least one universal, light, easy to assemble module, without mechanical interlocking elements and very solid, which
- may be attached optionally to a connector module, or be optionally attached to a ear module, or
- be optionally attached to multiple exhibit applications;

all above act as basic pieces to create a plurality of forms of exhibit stations, which may be growing in horizontal and/or vertical way.

The universal module which makes part of the dismountable, ultra light stations system to exhibit items and attend customers of the present invention is formed by a vertical body of cross section deposit in general elliptical way, which is provided of a cover or lid plate, rigid, e.g., from Formica, which provided in its margin edge zone of the inferior surface of a projected ring or ledge parallel to the edge, and around the wall projected vertically down of said ledge, it is fixed attached to one of the two strips of a hook and loop type fastener, e.g., Velcro (registered brand from Velcro USA®), being the other strip of the hook and loop fastener attached along the internal surface of the upper cross section edge of a laminar flat body, formed by a series of elongated elements of wood joined each other in relation side to side by a glue able to form a flexible union between said two contiguous elements, so that by executing pressure on said strips facing the Velcro closing, a stable and firm union will be formed between the upper horizontal external edge of said laminar flat body, formed by the series of elongated wood elements, mentioned before, and the lid or cover member of said universal module.

For purposes of the description, the flexible flat structure formed by the series of elongated wood elements attached each other in relation to the side to side by a binding able to form a flexible union between contiguous elongated elements, and with its major base adhered to a textile material cloth, will be named along the present description with the designation "Tensaflex". Wood elongated elements forming said flat unit have a trapezoidal cross section, of parallel bases, with their lower base directed to the interior of the room formed, and they are attached each other in side to side relation by an adhesive able to form a flexible union; through the higher base of each said elongated wood element, they are attached by an adhesive to a clothing or rug of textile material. It will be observed that given the trapezoidal shape of the cross section of said elongated elements, along them, it is defined between each pair of them, an empty space in angular shape, which allows a turn degree to close them each other from the lateral walls oblique to the adjacent elongated elements. As a consequence of the above, the Tensaflex material mentioned previously may be adapted to form constructions of curved walls and be adapted to form different curvature arches.

The vertical body of the universal module deposit, which has a cross section generally in elliptic form, may include a variety of objects that are adapted to the shape of said vertical body of deposit, such as in example a polystyrene refrigerator of cross section in general elliptic form. However, in the construction of the universal module that makes part of the dismountable, ultra light stations system to exhibit items and attend customers with the present invention, it may be included one or more internal cross section partition walls of shelves, which are attached fixedly to the internal wall of the vertical layer of Tensaflex by a Velcro joint formed mediating the cooperation of a Velcro joint band, attached around the external body of the shelves, with a respective Velcro strip fixed at the height considered as convenient, around the curved internal surface of the layer of Tensaflex forming the side wall of the universal module. The layer of Tensaflex forming the side wall of the universal module is provided of a rectangular opening along its height, through which provides access to the interior space of storage of said universal mode. In said rectangular opening, it is normally installed a door by conventional means. Shelves installed cross sectionally to different levels along the height of the universal mode have an edge section cut in a straight line of length substantially equal than the width of said opening of the door to which cited shelves edge is facing.

Dismountable, ultra light stations system to exhibit items and attend customers of the present invention may comprise only the universal module; or it may comprise only or the universal module and multiple applications of exhibition, or several application of exhibitions implying the vertical growth of the system; or it may comprise the universal modules, and/or connecting modules and/or era modules, and/or multiple exhibition applications, and attend customers implying the horizontal growth of the system or the vertical growth of the system, of a mixture thereof.

The lid or cover making part of the universal module described before, is in general of elliptic form. However, said lid or cover may be also n different shapes or configurations. Thus, in example, the lid or cover may be elliptic or rectangular.

The lid or cover of the universal module, or connector module, or ear module may be essentially flat, or be modified to receive multiple exhibition applications requiring said modification. Such modification of the lid or cover of the universal module, or connector module, or ear module, may consist on being adapted to act as a reception tray of objects, or it may have in its upper surface, a coat rack type structure to hang clothing. The lid or cover of the universal mode, or connector module, or ear module may also include an opening to receive envelopes or similar objects, or has an upper access door turning freely by the use of a hinge.

In a particularly preferred mode, the lid or cover of the universal mode, or connector module, or ear module making part of the system of the present invention, includes one or more openings intended to receive a parasol or the beams to place advertisement, an advertisement pennant or similar objects. Also, the lid or cover of the universal mode, or connector module, or ear module may include one or more openings intended to receive cabling of electronic equipment, such as in example, a computer.

In order to provide an exhibiting structure and attend customers, the system of the present invention envisages to install one or more specially configured connecting modules, between the universal modules described above, or between ear modules, or between mixtures thereof. The present invention comprises several types of connecting modules allowing to join two, three or more universal modules or ear modules, so that the system may grow in horizontal way. For purposes of the description of the present invention, said modules are designated as two-way connecting, three-way connecting modules or more.

For the case of two-way connecting modules, straight or curved ones, each one of said connecting modules is formed by a board of cover lid in elongated shape that may be straight or that may be extended along a curvature arch which is formed, and follows the same curvature in which universal modules or ear modules are formed and included in a exhibition station arranged in way of circle.

Base board of the two-way connecting module used between two universal modules or between two ear modules or between mixtures thereof, arranged in a station, is of elongated shape that extends longitudinally in straight line, or along a curvature arch formed to the curvature of the opposite parallel sides of the board of cover lid, when the exhibiting station has a configuration in mode of circle. Along the exterior longitudinal edges opposite to the base board of the two way connecting module there is a rabbet, which is used to the purpose indicated below.

In case of three-way connecting modules, allowing to join three universal modules or three ear modules of mixtures thereof, each of said connecting modules is formed by a board of cover lid in irregular shape in way of triangle that instead of vertices or tips, it has curvature arches which are formed and follow the same curvature than the side wall of the universal modules, or the ear modules included in the exhibiting station.

The base board of the three-way connector module used between three universal modules or between three ear modules or mixtures thereof, arranged in a station, has irregular shape in way of triangle that instead of vertices or ends, it has curvature arches which are formed, and follow the same curvature than the side wall of the universal modules, or the ear modules included in the exhibiting station. Along the exterior opposite longitudinal edges opposite of the base board of the three-way connector module, there is a rabbet, which is used to the purpose indicated below.

In case of both two-way connecting modules and three-way connecting modules, or more way modules, vertical side walls of the connecting module—which are two in case of two-way connecting module and three for three-way connecting module—are formed, each by a vertical layer of material designated as Tensaflex, described here, which upper and lower horizontal edges are joined by a Velcro union formed between the cooperative Velcro strips arranged both along said internal horizontal edges, upper an lower, of the layer of Tensaflex, and along the rabbets arranged in said external longitudinal edges of the cover lid board, as well as along each rabbet disposed along the before mentioned opposite external longitudinal edges, of the base board of the connecting module.

To form the exhibiting stations and to attend customers, the system of the present invention uses as basic elements above described universal modules, and/or above mentioned connecting modules, and/or ear modules, and/or multiple exhibiting applications. To achieve this objective, side walls of connecting modules have a vertical band of Velcro in their side ends, which allow to join in detachable way, connecting modules to the textile cloth that are in the exterior surface of the side wall of the universal modules or the ear module. By alternating connecting modules between the universal modules or between ear modules, an user may create a plurality of designs and shapes of exhibiting station which goes from a simple set composed by two universal modules and a two-way connecting modules joining said universal modules, to much more complex exhibiting stations that use several universal modules joined by straight or curved, two-way or three-way connecting modules, forming stations circular, oval, rectangular with curved vertices, in Y, and any other type of exhibiting station that the user desires.

The system according to the present invention also envisages the provision of means to extend, either in straight line, arched line or any other arrangement, the installation of universal modules integrating said exhibiting stations, and to attend customers. This way, to provide an exhibiting station with their modules installed in straight line, curved, in Y, or any other arrangement, the present invention envisages to install along one or both sides of the symmetry longitudinal axis of any of the universal modules in the exhibiting station formed, one or a series of ear forming modules in straight line, which heights reduces as the installation places is far from any of the universal modules of the formed exhibiting station.

Ear modules consist of units formed by a cover lid board which has its external contour line of posterior end formed along a portion of the curvature arch of the end of an ellipse, and its contour line of frontal opposite end formed at the exterior surface of the vertical side wall of the universal module. The cover lid board may present a contour in general elliptic way, or un general rectangular or square shape.

Side vertical wall of each ear module is formed by a continuous section of the material designated as Tensaflex, described above. As indicated before, height of the ear module diminishes progressively as said module, in its installation place, is far form said universal module. Bottom wall of each ear module is formed by a rigid material plate, i.e., pressed wood. Said bottom wall presents in one of its ends, a grooved area along a curvature arch, that under installed condition, is adapted and adjusted to the curvature arch of the end exterior surface of the vertical side wall of the universal module.

An exhibiting station may include a plurality of ear modules with progressively diminishing heights as said modules, in their installation place, are far from said universal module.

Side ends of the side wall of ear forming modules have a vertical strip of Velcro, which allows to join in detachable form, the ear forming modules to the textile cloth that is in the exterior surface of the side walls of universal modules giving higher stability to the exhibiting station formed by said ear modules.

Universal modules, or connecting modules or ear forming modules may use in their assembling signals or guide points on the cover boards, base boards and side walls indicating the user the most appropriate way to join different pieces of modules integrating the system of the present invention.

Another element making part of the present invention consist in multiple exhibiting applications that may be used in the dismountable, ultra light stations system to exhibit items and attend customers of the present invention. Said multiple exhibiting applications may be selected from the group consisting of showcase modules, light modules to place advertisement or similar objects that may be lighted, parasols, advertisement pennants, CD exhibitors, book exhibitors, diverse items exhibitors, perforated and non perforated trays holding each other or slopping by a supporting element joined to the tray by a hinge. These multiple exhibiting applications are generally placed on the flat cover of the universal module, or the connector module of ear module, or on the cover to another multiple application module, without the cover suffering from any modification. Nevertheless, it is also envisaged that these multiple exhibiting applications are supported on a modified cover of the universal module, of the connecting module or ear module, or on the modified cover of another multiple exhibiting application, which may exhibit grooves, have Velcro strips or similar adaptations.

One of the preferred multiple exhibiting applications consists on a showcase module in elliptical general form, which is provided of a cover lid and, vertically far from it, of a base board, having in the upper surface of said base board, toward inside and around their external edges, a grooves receiving two side beams in way of posts, which also have grooves adapted to receive one, two or more boards of shelves of transparent material, each with its respective separator, and an upper beams joining both beams to give stability to the structure and to support the cover lid of the showcase module to which it is attached by a Velcro type union or any other type of union, having said showcase module a frontal panel or transparent material and two posterior panels of transparent material matching the groove of the base board, being said posterior panels separated each other to define a door opening.

Above described showcase module includes also a door installed by conventional means in the door opening giving access to the inside space of storage of the showcase module.

Another of the preferred multiple exhibiting applications consists on a light advertisement to place advertisement with a vertical body of deposit of cross section in general elliptic form, which is provided of a cover lid and, vertically separated from it, of a base board, having in the upper surface of said base board, toward the center and around their external edges, a groove receiving two side beams in way of posts, united in the upper part by a beams giving stability to the structure and supporting the cover lid of the light module to which it is attached by a Velcro type union or any other type of union. The base board is also adapted to install one or more bulbs or similar objects, and having said light modules a frontal panel and a posterior panel, both or only one of transparent material matching in the groove of the base board. Said panels allow to place any type of advertisement or similar object that may be lighted.

Another of the preferred multiple exhibiting applications consist on a CD exhibitor having a structure that may match in a groove or that may be adhered to the lid or cover of rectangular type of a universal module as that described before, by a Velcro union strip. Said CD exhibitor generally comprises a frontal panel and a posterior panel that are supported either by pressure each other or they join in their upper part by a Velcro union strip. This exhibitor also includes two side panels with form of triangle held by frontal and posterior panels by pressure executed on them, or attached to said posterior and frontal panels by a Velcro type union. These posterior and frontal panels generally have shelves that allow them to support CD's or similar objects.

Another of the preferred multiple exhibiting applications consist on a book or similar objects exhibitors having a structure that may match in a groove or that may be adhered to the lid or cover of rectangular type of a universal module as that described before, by a Velcro union strip. Said book or similar object exhibitor generally comprises a frontal panel and a posterior panel that are supported either by pressure each other or they join in their upper part by a Velcro union strip. This exhibitor also includes two side panels with form of triangle held by frontal and posterior panels by pressure executed on them, or attached to said posterior and frontal panels by a Velcro type union. These posterior and frontal panels generally have shelves that allow them to support books or similar objects.

Another of the preferred multiple exhibiting applications consist on a diverse items exhibitor having a structure that may match in a groove or that may be adhered to the lid or cover of rectangular type of a universal module as that described before, by a Velcro union strip. This exhibitor comprises a central panel matching central vertical groove of two side panels, forming a "H" shape structure from a upper view, and a plurality of shelves matching in horizontal way, in corresponding grooves specially arranged in the internal part of side panels to form a series of racks to receive any type of items which adapt to the size of said racks.

Another of the preferred multiple exhibiting applications consist on perforated and no perforated trays, being said multiple exhibiting application, a structure composed by frontal, posterior and side trays which are supported either by pressure each other or they join in their upper part by a Velcro union strip, or being said multiple exhibiting application, a structure composed by a single tray which is slopped by a supporting element attached to said tray by a hinge that can be supported in a groove or that may be adhered to a Velcro strip specially arranged on the rectangular lid or cover of the universal module.

BRIEF DESCRIPTION OF THE DRAWINGS

Other purposes characteristics and advantages of the present invention will become evident according to the following detailed description regarding the accompanying drawings, wherein.

DETAILED DESCRIPTION OF THE INVENTION

According to the present invention, here it is provided a dismountable, ultra light stations system to exhibit items and attend customers, which comprises at least one light, easy to assemble universal module, without mechanical interlocking elements and very solid, which may optionally be attached to a connecting module, or optionally be attached to an ear module, or optionally be attached to multiple exhibiting applications; all above act as basic pieces to create a plurality of forms of exhibit stations, that may grow in horizontal and/or vertical direction according t the needs and preferences of the user.

Figure 1:
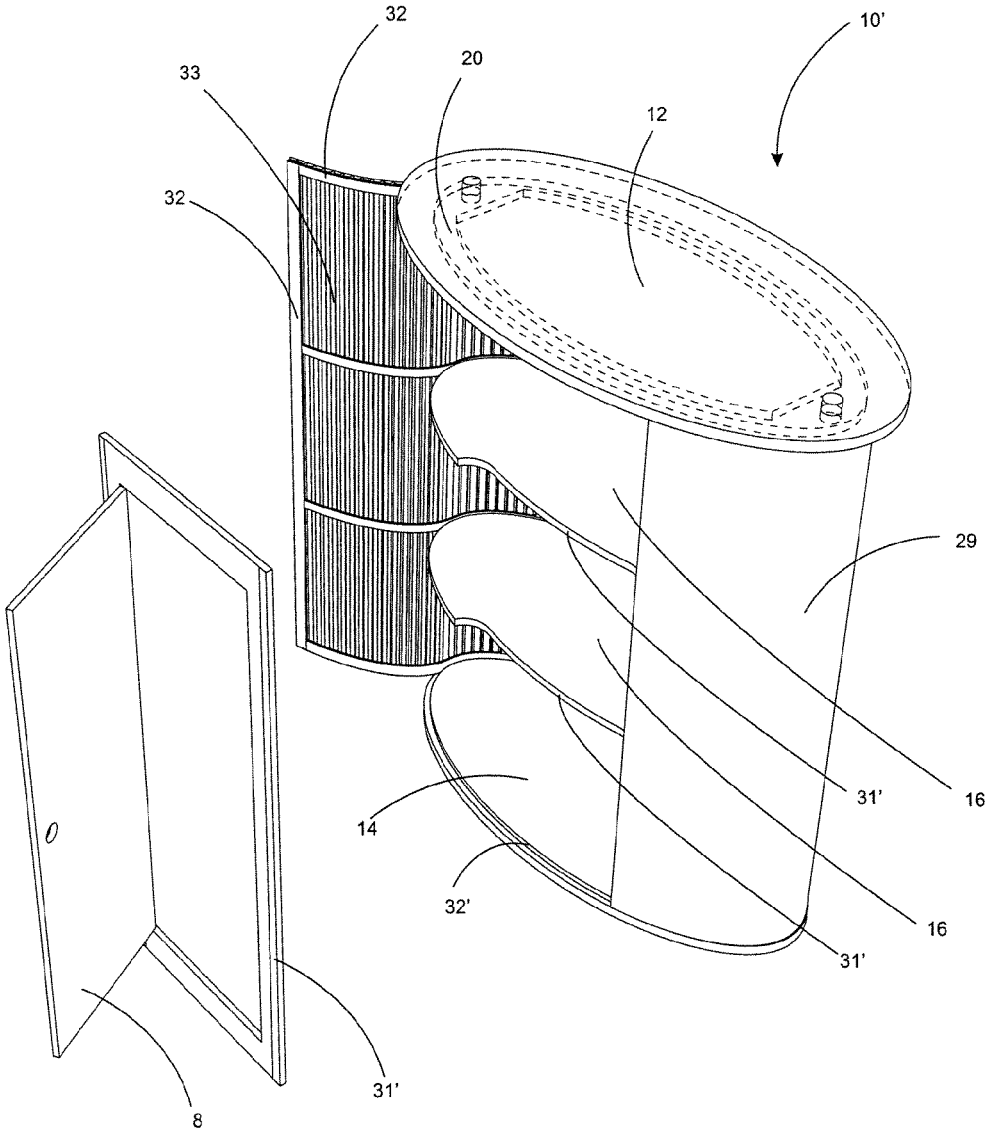
FIG. 1 is a view in perspective of a universal module which makes part of the exhibit stations and to attend customers, of the present invention.
Figure 5:
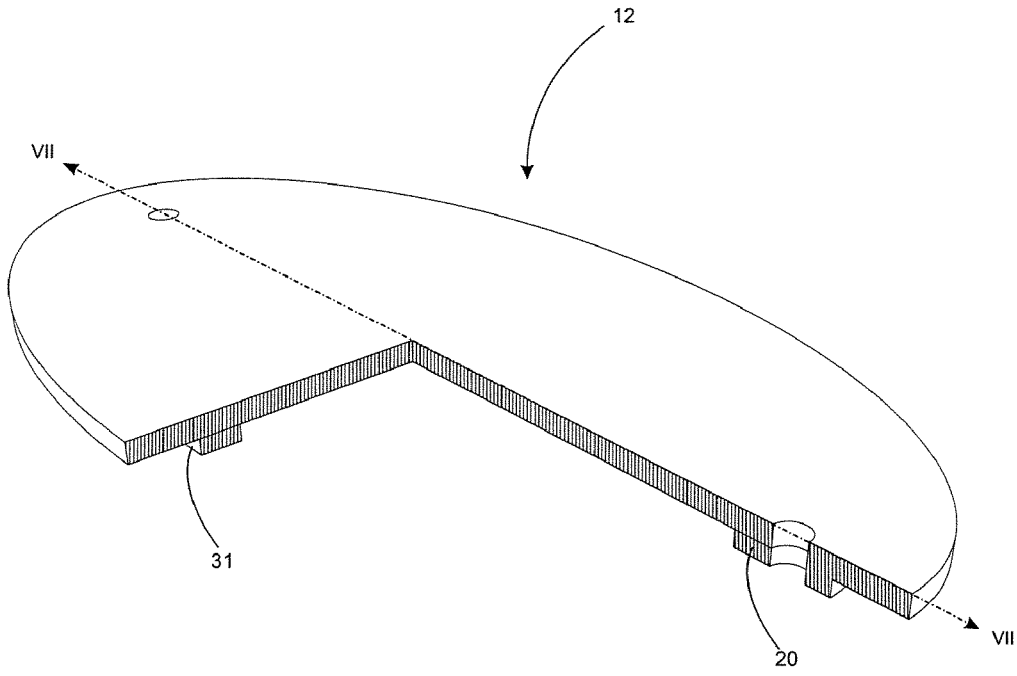
FIG. 5 is an isometric view of a cover lid of flat elliptic type, of a universal module as that illustrated in FIG. 1.

The universal module of the present invention is illustrated in FIG. 1 with the reference number 10', which may be associated as one unit of the general structure of the exhibit station of commercial items or for other purposes of stations for public attention. The cited universal module 10' comprises in its structure a plate or cover lid 12, of rigid material, i.e., from Formica, in elliptic way. As illustrated in FIG. 5, cover lid 12 is provided, in the margin edge of its inferior surface, of a ledge 20 parallel to its edge. The ledge has fixedly joined around its exterior wall, extending vertically down, one of the two bands or strips of a hook and type fastener, e.g., a Velcro (registered brand from Velcro USA®)31, being the other strip 32 cooperating to form said union firmly adhered along the internal surface area of the cross section edges (FIGS. 2 and 3), of a flexible partition wall 30, (FIG. 2) forming the vertical side wall 10 of the universal module 10'. Flexible partition wall 30 is formed by a series of elongated wood members 33 joined each other longitudinally in side to side relation by the action of a glue able to form a flexible union between the sides which are in contiguous relation of two of said adjacent elongated members.

Figure 2:
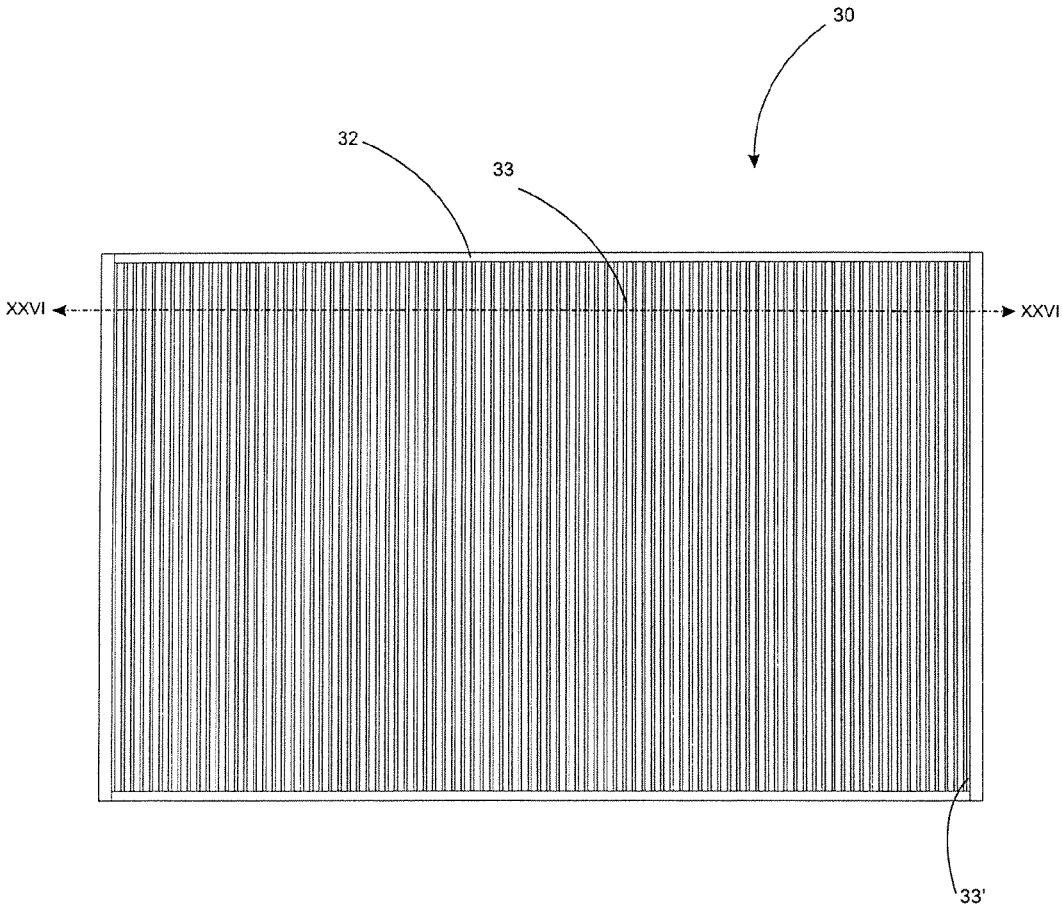
FIG. 2 is a plant view of the internal face of a layer of the material designated as "Tensaflex", provided in its perimeter edge area of a cooperating band to form a "Velcro" union.
Figure 4:
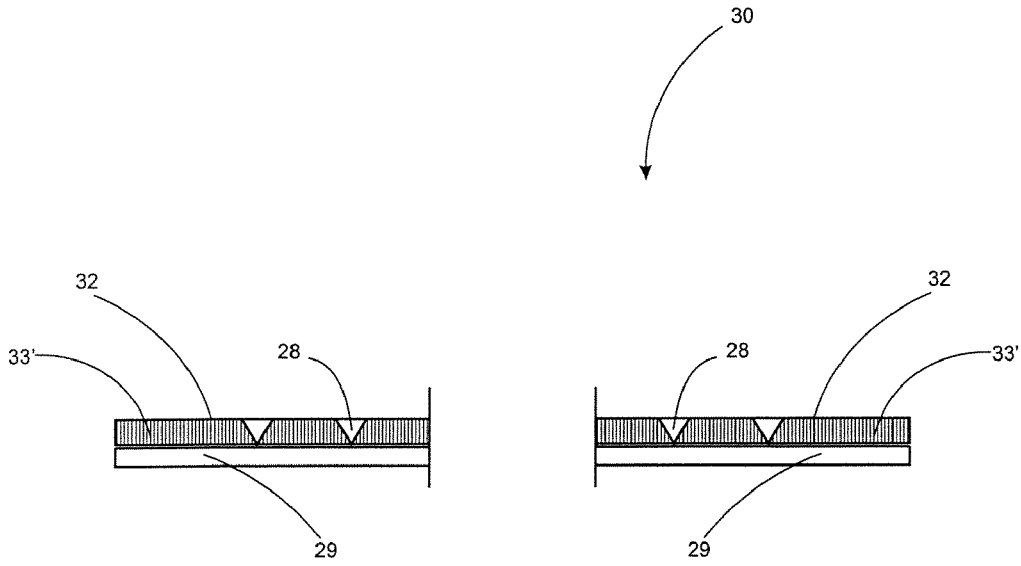
FIG. 4 is a cross section view through a layer of Tensaflex material illustrated in FIG. 2.

Elongated wood members 33 forming said flexible partition wall 30 have a cross section of regular trapezoidal shape with its lower base directed toward the inside of the room to be formed, and with its higher base joined by an adhesive, to a layer of cloth of textile material 29 (FIG. 4). Elongated wood member 33' (FIG. 4) located in the edges is wider than that of elongated elements disposed in the remainder area of said partition wall, since said member 33' will support the stresses derived from the installation of the door 8 (FIG. 1) of the cabin. Given the trapezoidal form of the cross section of said elongated elements, between each pair of them, it is defined an empty space 28 of angular shape (FIG. 4), space which allows a degree of turn for mutual closing of oblique side walls of elongated adjacent elements 34 (FIGS. 2 and 4). The above described flexible laminar material, is designated along the present specification, for purposes of easy reference, with the term "Tensaflex".

Figure 6:
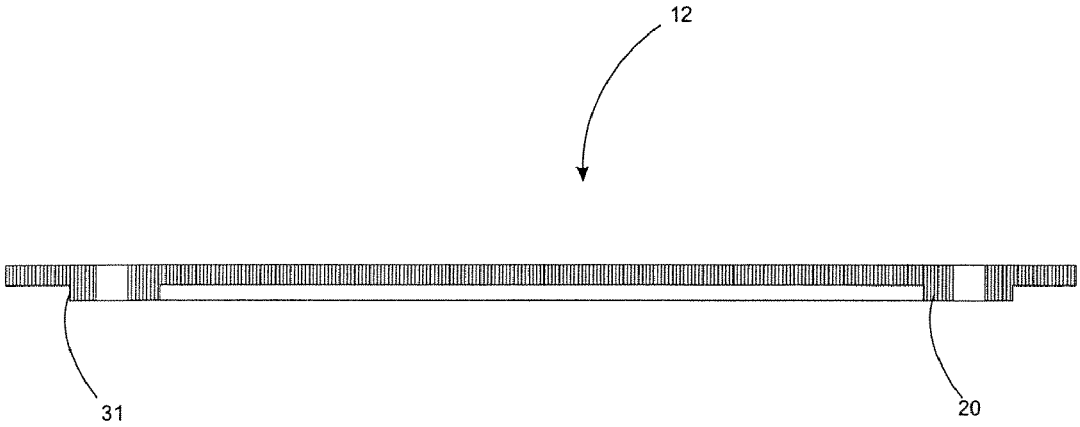
FIG. 6 is a longitudinal cut view, taken along the VII-VII line in FIG. 5, of a cover lid of flat elliptic type of a universal module as that illustrated in FIG. 1.

Continuing with the construction of the universal module 10', its vertical side wall 10 is formed by a partition wall 30 (FIGS. 1 and 2) of material Tensaflex, superimposing its upper cross section 32, (FIG. 2), on a union strip Velcro 31 arranged firmly around the peripheral exterior surface of the ledge 20 (FIGS. 5 and 6) and applying pressure to form the Velcro union between the before cited strips 31 and 32.

Additionally, since the structure of the universal module 10' comprises also a bottom board or partition wall 14 (FIGS. 7 and 8), it is also similarly joined, by a Velcro union, to the flexible partition wall 30, forming the vertical wall 10, which along its inferior cross sectional strip 32, under its assembled condition, will be faced to join a respective band of Velcro 31 arranged firmly around the exterior vertical surface 32' of a ledge 22 which is projected outside of the board from its base 14.

Figure 3:
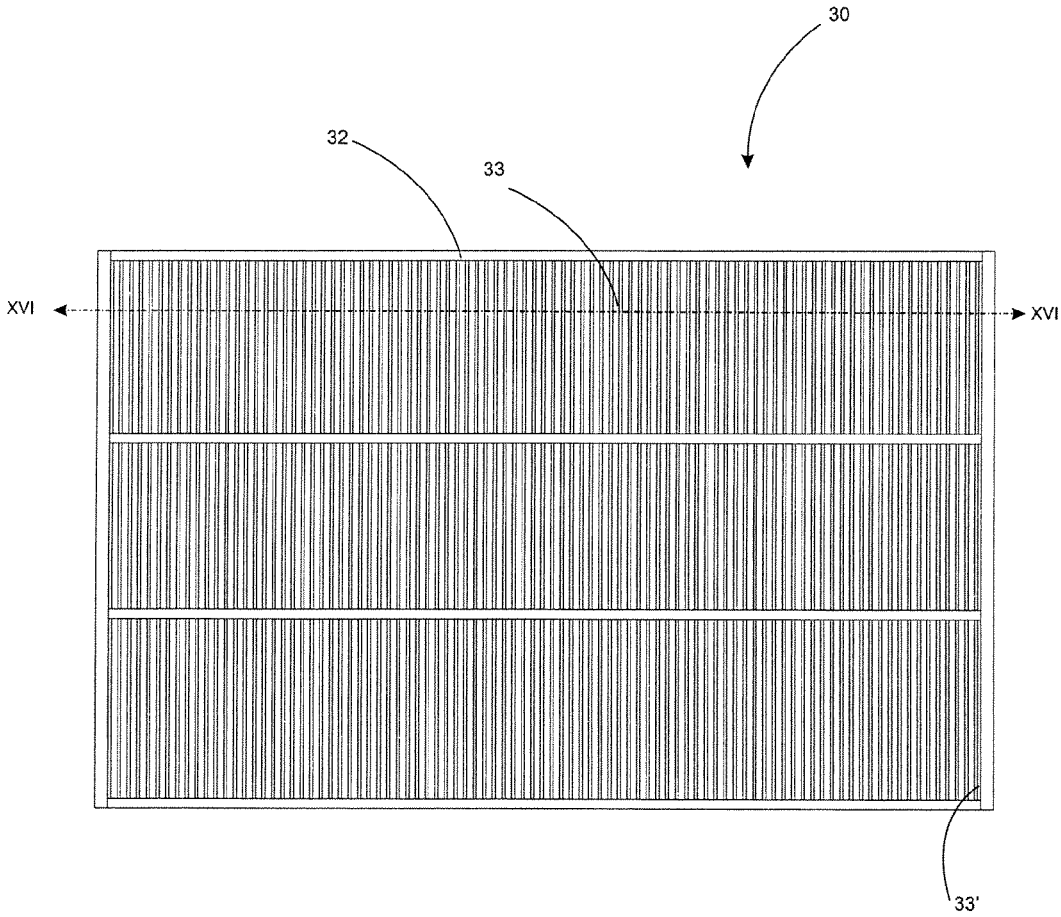
FIG. 3 is a rising view illustrating in schematic way the arrangement of strip sections of "Velcro" union for the join of cross section partition walls in a flat section of Tensaflex; of the type used to form de side wall of the universal module.
Figure 9:
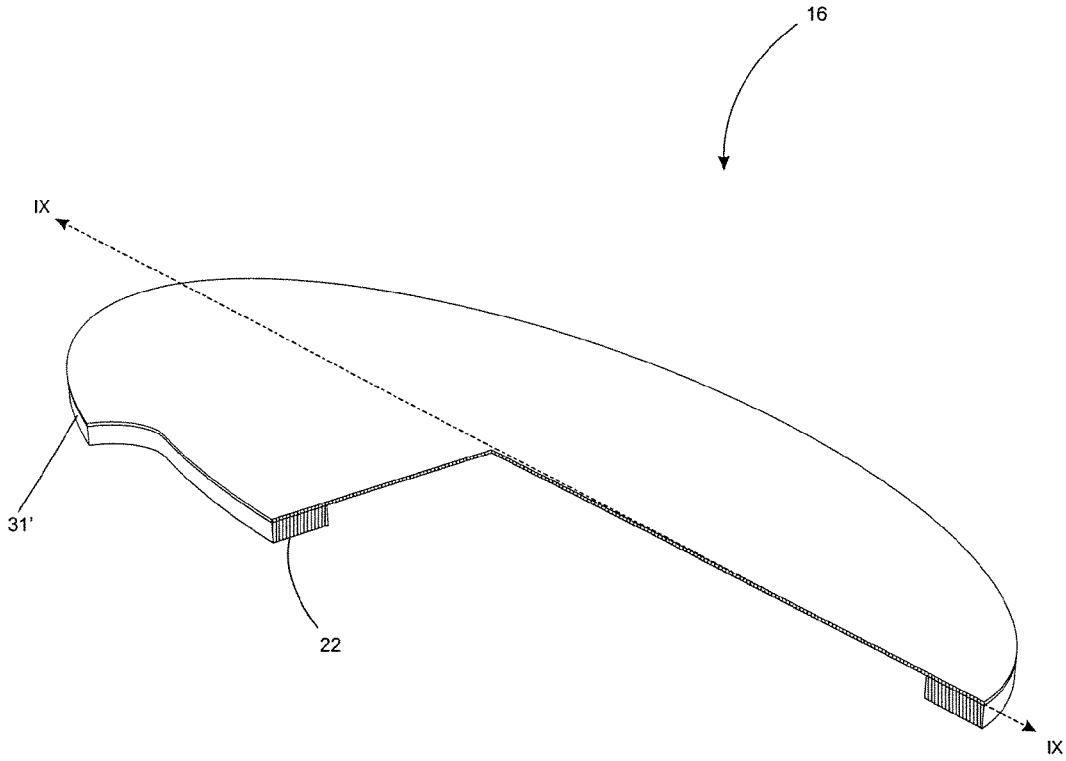
FIG. 9 is an isometric view, from the inferior side, of a shelf board as used in a universal module as that illustrated in FIG. 1.
Figure 10:
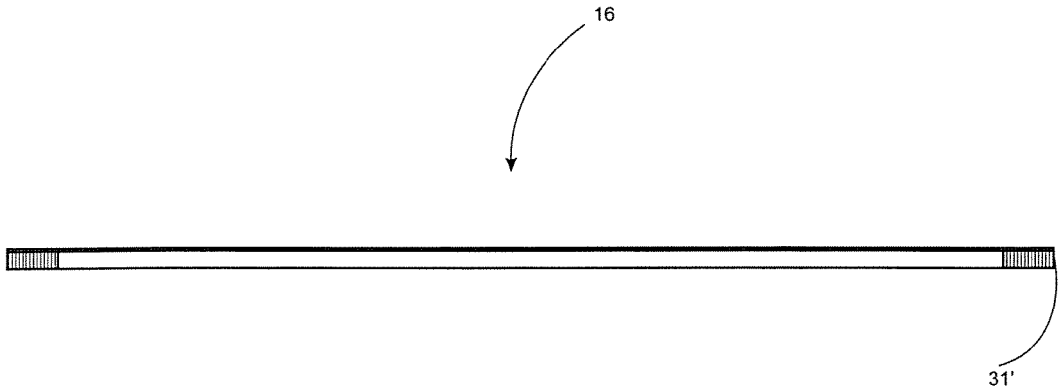
FIG. 10 is a longitudinal cut view, taken along the IX-IX line in FIG. 9, of the entrepaño board illustrated in FIG. 9.

Universal module 10' of the system of the present invention, may have its vertical body for deposit without any other additional element adhered to the interior of its structure, or may also include along its height, one or more internal cross sectional shelves or partition walls 16 (FIGS. 1, 9 and 10), which are fixedly joined to the internal surface of the vertical wall 10 of the universal module, by a Velcro union which is achieved by the cooperation of a strip section of Velcro union 31',joined around the external edge of the shelf 16 which, under its installed condition, is facing a cross section of Velcro strip 32 arranged cross sectionally at a convenient desired height on the internal wall of the side wall 10 formed by a partition wall 30 of Tensaflex, as illustrated in FIG. 3.

Side wall 10 of the universal module 10' formed with the partition wall of Tensaflex 30, may form a vertical body for totally closed deposit, or may define a rectangular opening along its height, through which these is access to the interior space of said universal module 10'. In said rectangular opening it is normally installed a door 8 (FIG. 1) by conventional means. Shelves 16 (FIGS. 1, 9 and 10) installed cross sectionally at different levels along the height of the universal module 10' have a edge section cut in straight line, of length substantially equal than the size of the width of said door, to which cut edge of said shelves is faced.

Figure 7:
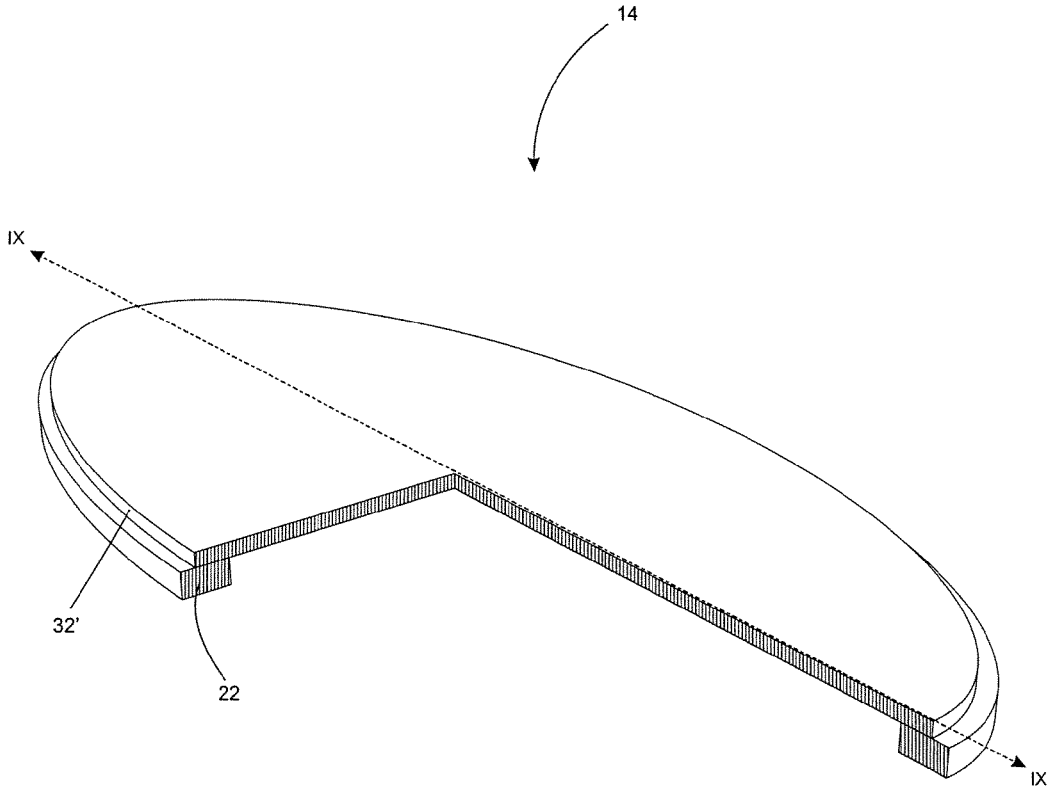
FIG. 7 is an isometric view of the base board of a universal module as that illustrated in FIG. 1.
Figure 8:
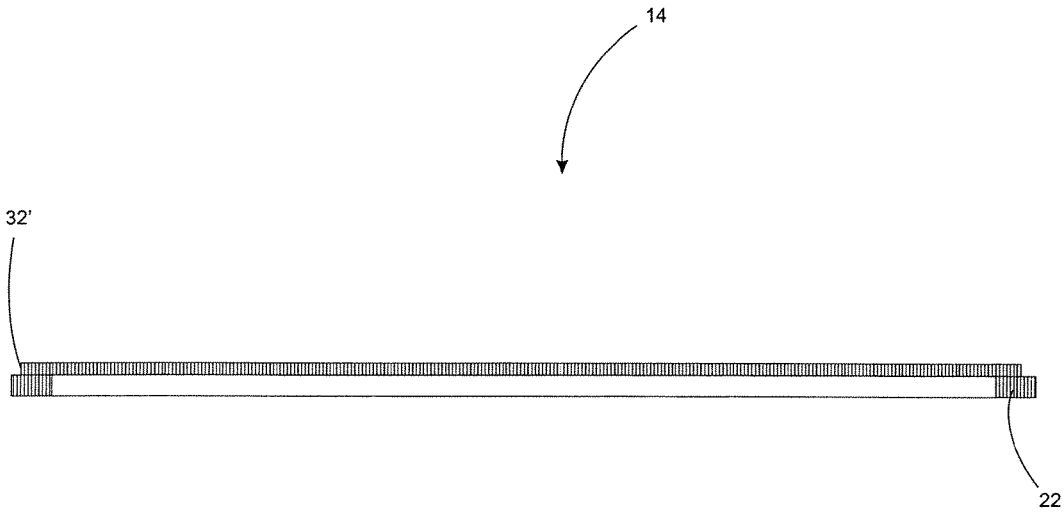
FIG. 8 is a longitudinal cut view, along the IX"-IX" line of the base board illustrated in FIG. 7.
Figure 11:
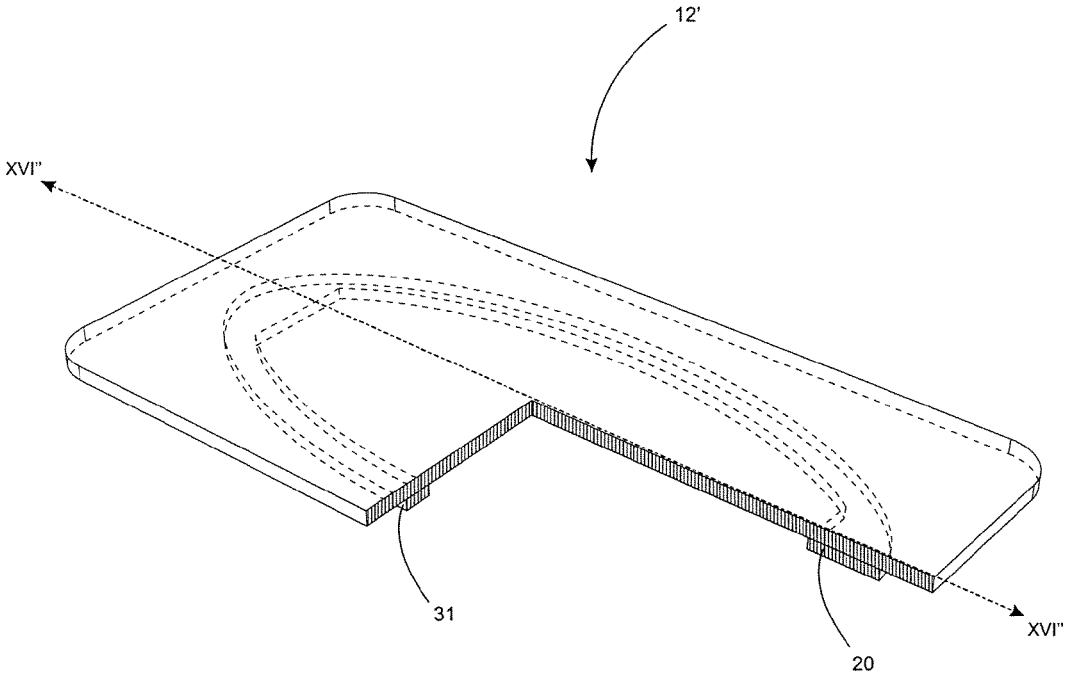
FIG. 11 is an isometric view, from the upper part of a universal module provided of a cover board in rectangular shape 12'.
Figure 12:
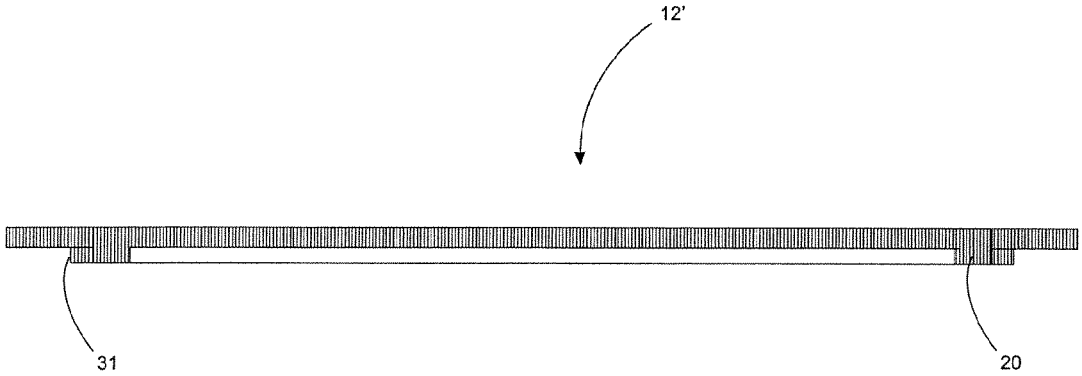
FIG. 12 is a longitudinal cut view, taken along the XVI"-XVI" line in FIG. 11.
Figure 35:
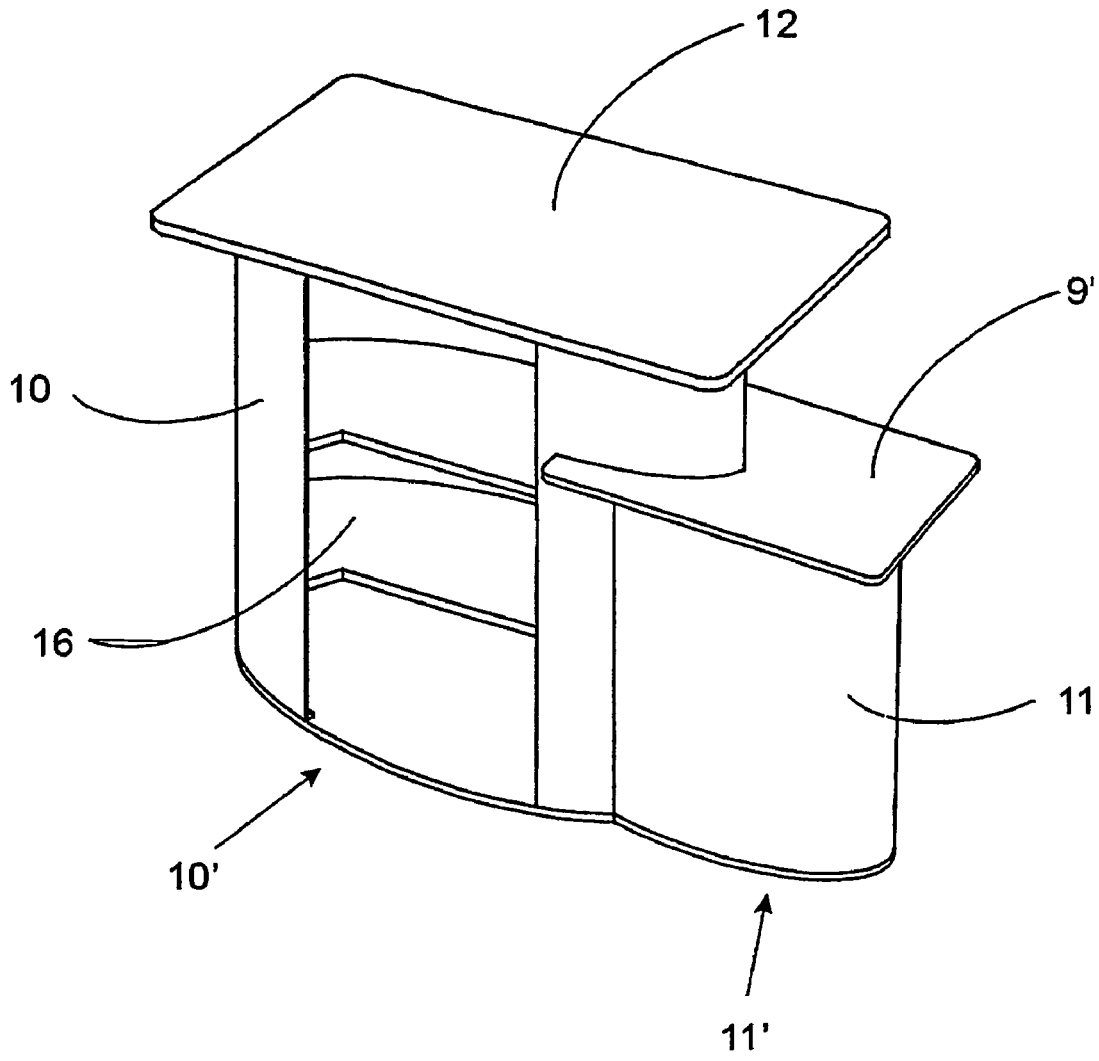
FIG. 35 is a perspective view of an exhibit station and to attend customers according to the invention, teaching the use of an ear module as that illustrated in FIG. 28, when it is attached to a universal module as that illustrated in FIG. 1, with rectangular lid or cover forming a simple exhibit station.

Lid or cover 12 making part of the universal module illustrated in FIG. 1, may be elliptic as in the case of FIGS. 7 and 8, or rectangular as in the case of FIGS. 11, 12 and 35, or may comprise all the non limiting possibilities of lid or cover that were described here previously.

As indicated before, the system of the present invention comprises not only the use of at least one universal mode, described before, but also it comprises the installation of one or more specially configured connecting modules, between universal modules described above. Said connecting modules comprise several types allowing to join two, three or more universal modules, and which are designated in the present invention as two-way, three-way or more connecting modules, as explained before.

Figure 13:
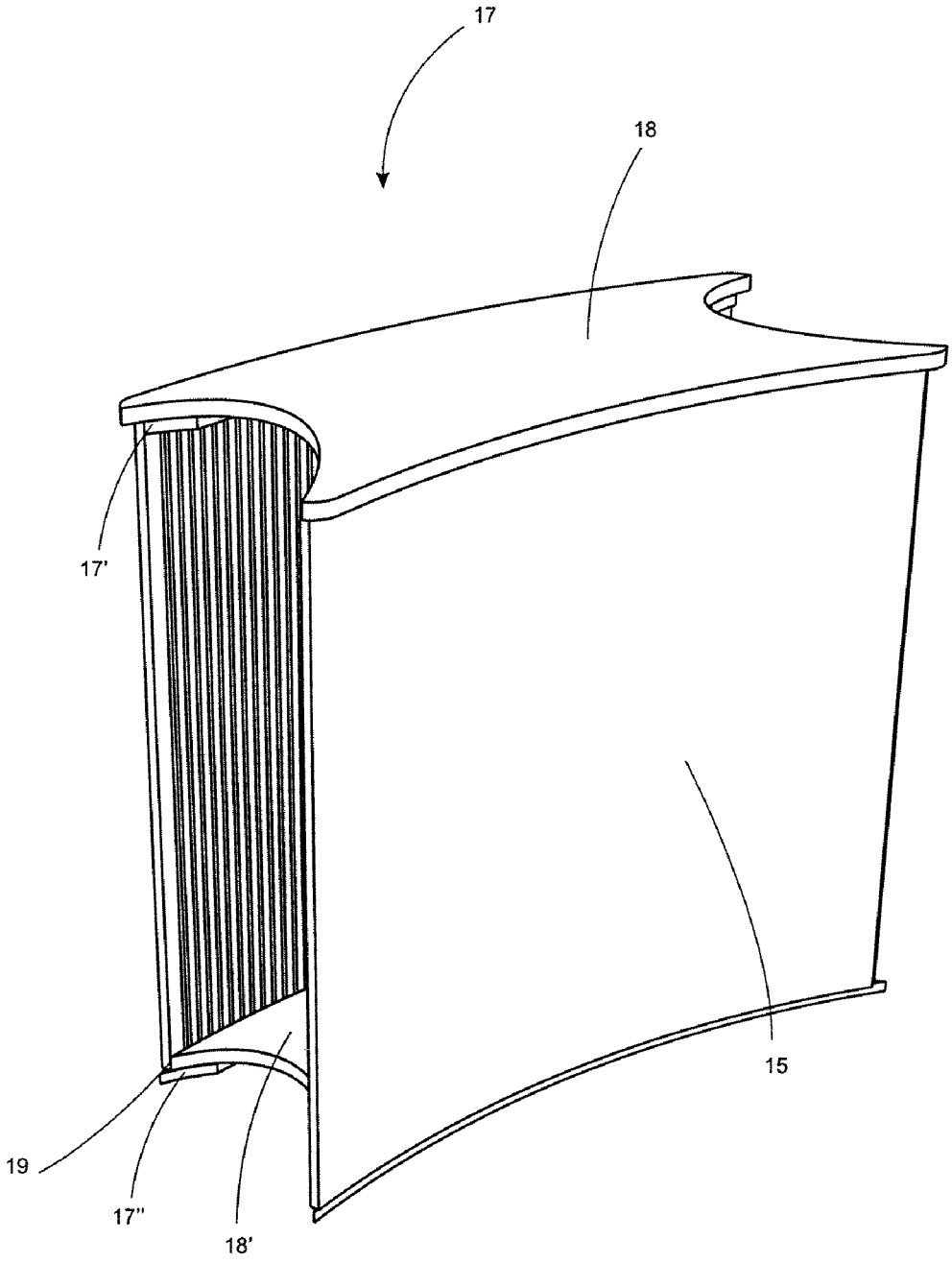
FIG. 13 is a perspective view showing a curved two-way connecting module used according to the invention, to provide an exhibiting station with its universal modules arranged on line or in a circular installation.
Figure 14:
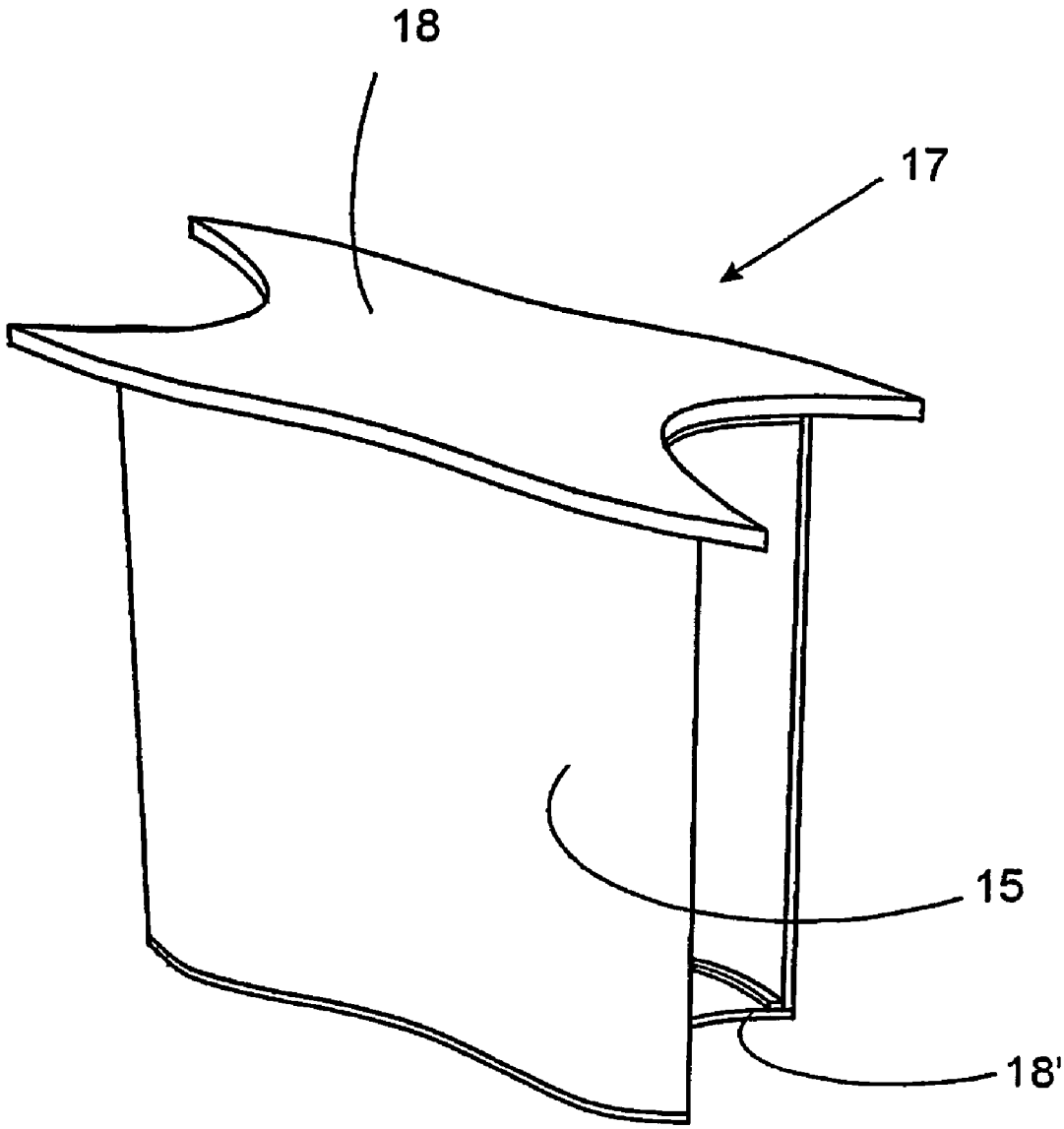
FIG. 14 is a perspective view showing a straight two-way connecting module used according to the invention, to provide an exhibiting station with its universal modules arranged on line or in any other type of configuration.
Figure 15:
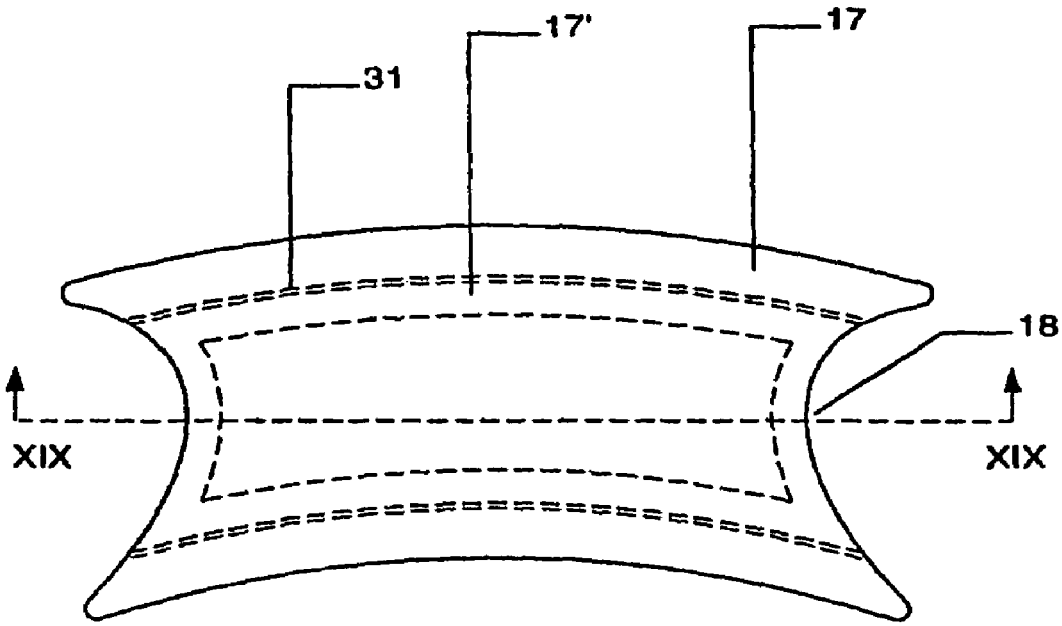
FIG. 15 is a plant view, of the cover board of the connecting module illustrated in FIG. 13.
Figure 16:
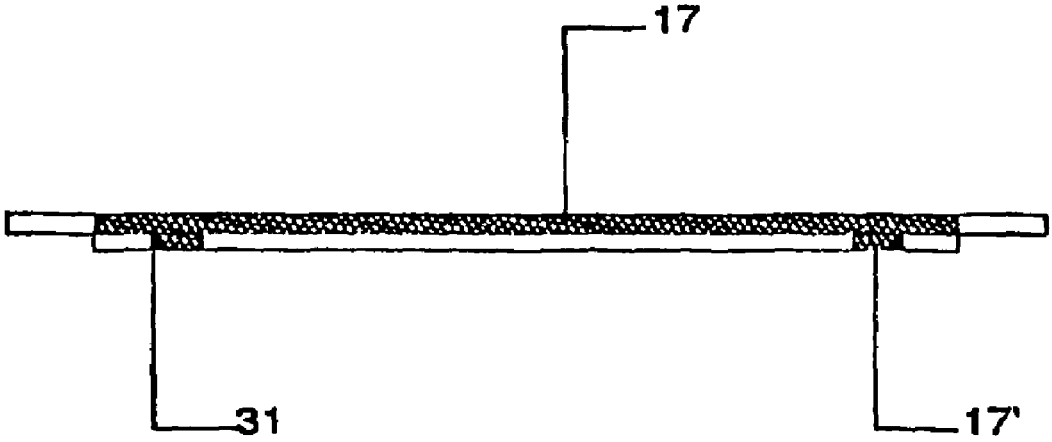
FIG. 16 is a vertical view, taken along the XIX-XIX line of the cover board illustrated in FIG. 15.

In the case of two-way connecting modules, they may be curved as that indicated in the reference numeral 17 in FIG. 13, or straight ones as that observed in FIG. 14. Said curved connecting modules are formed by a cover lid board 18 (FIGS. 13, 14, 15 and 16), of elongated form which extends in longitudinal way along a curvature arch formed to the curvature in which universal modules 10' are installed, in an exhibit station of circular installation, as that illustrated according to the FIG. 21.

Figure 17:
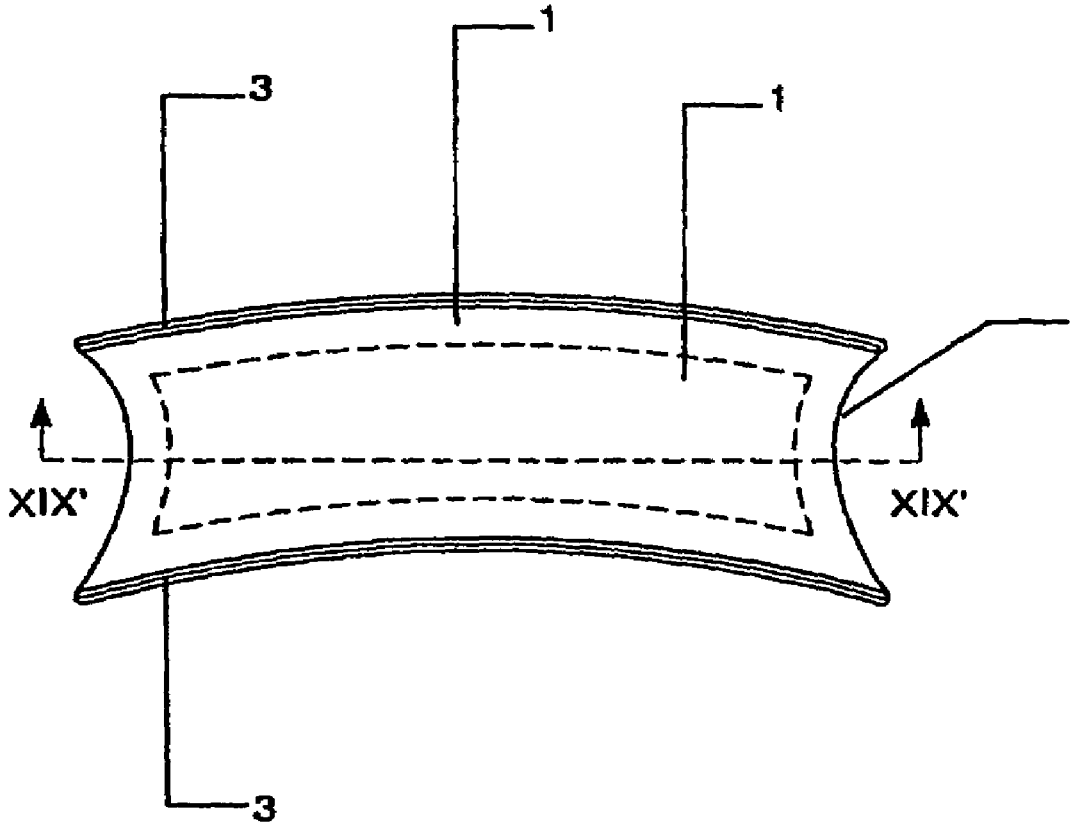
FIG. 17 is a plant view of the base of the connecting module illustrated in FIG. 13.
Figure 18:
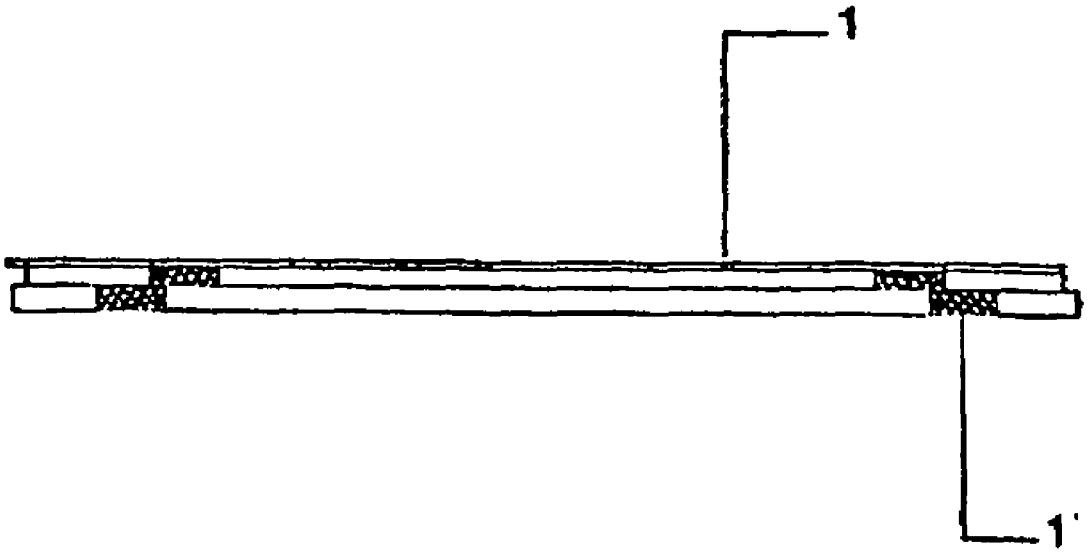
FIG. 18 is a vertical rising view, taken along XIX'-XIX' line of the base board illustrated in FIG. 17.

Against the inferior surface of the cover lid board 18 (FIGS. 13, 15 and 16) a board 17' is arranged, being the arranged in such way that between elongated edges of the cover lid board 18 and of the board 17', joined on their inferior surface, it is defined a rabbet on the vertical surface from which one of the Velcro strips is joined, which will cooperate with the other one of the Velcro strips joined along the upper cross sectional edge of the partition wall of vertical side wall 15, constituted by the material designated, and already described as Tensaflex. In similar way, against the upper surface of the bottom board 18'(FIGS. 17 and 18) there is a board 17",being said board 17" less wide than the bottom board 18', so that along their higher sides, there is a rabbet 19 on the vertical surface from which one of the Velcro strips is joined, and cooperates with a Velcro strip disposed along the inferior cross sectional edge of the board of material Tensaflex forming the vertical side wall 15 of said connecting module 17.

Figure 21:
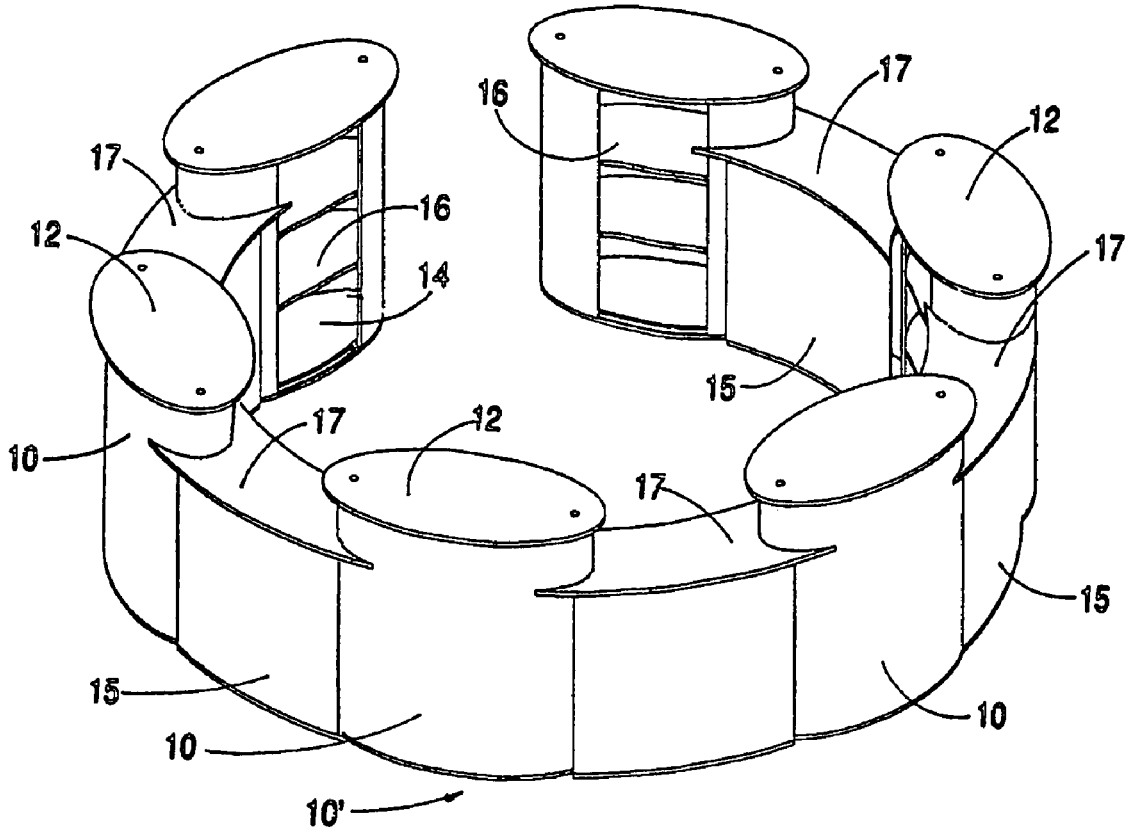
FIG. 21 is a perspective view of a more complex exhibiting station and to attend customers comprising universal modules joined by two-way connecting modules, of curved shape, arranged in a circular installation.

Curvature arch formed in the opposite ends of the cover boards 18 and of bottom boards 18'(FIG. 13), is geometrically configured to cover tightly the surfaces of each end of vertical walls 10 of universal modules 10', in a simple exhibit station in circumferential arrangement, as that illustrated in FIG. 21, so that vertical side wall 15 opposite each other, of the connecting modules 17, will be located in the same circumferential arrangement than said universal modules 10'.

Figure 19:
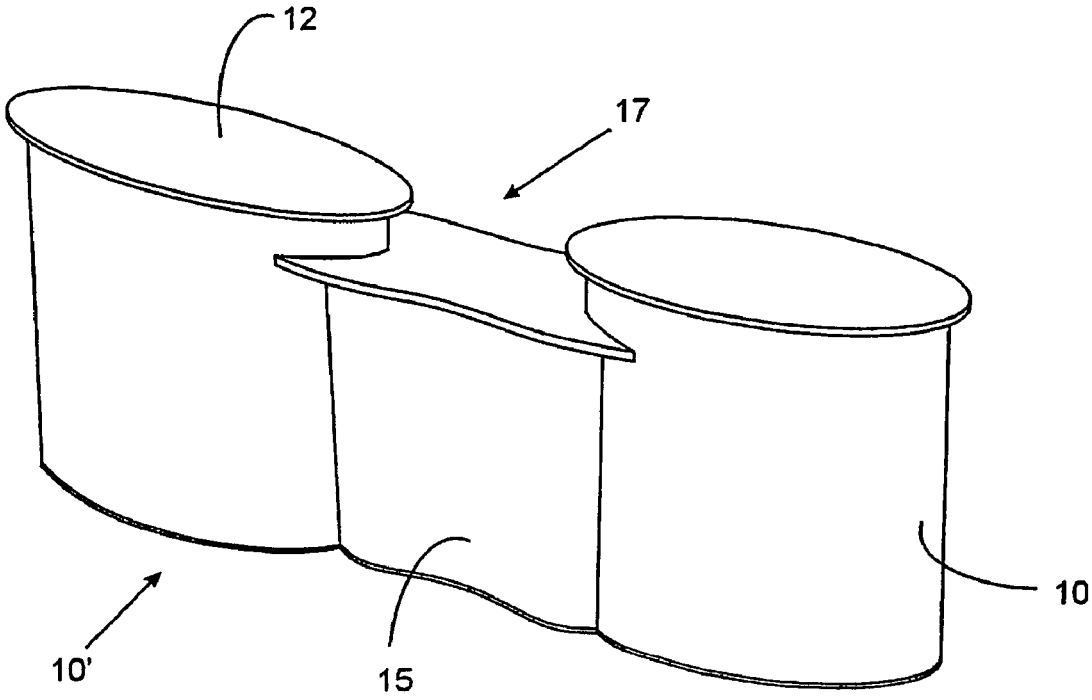
FIG. 19 is a perspective view of a exhibiting station and to attend customers according to the invention, teaching the use of a straight two-way connecting module as that illustrated in FIG. 14, to join two universal modules as those illustrated in FIG. 1, forming a simple exhibiting unit.
Figure 20:
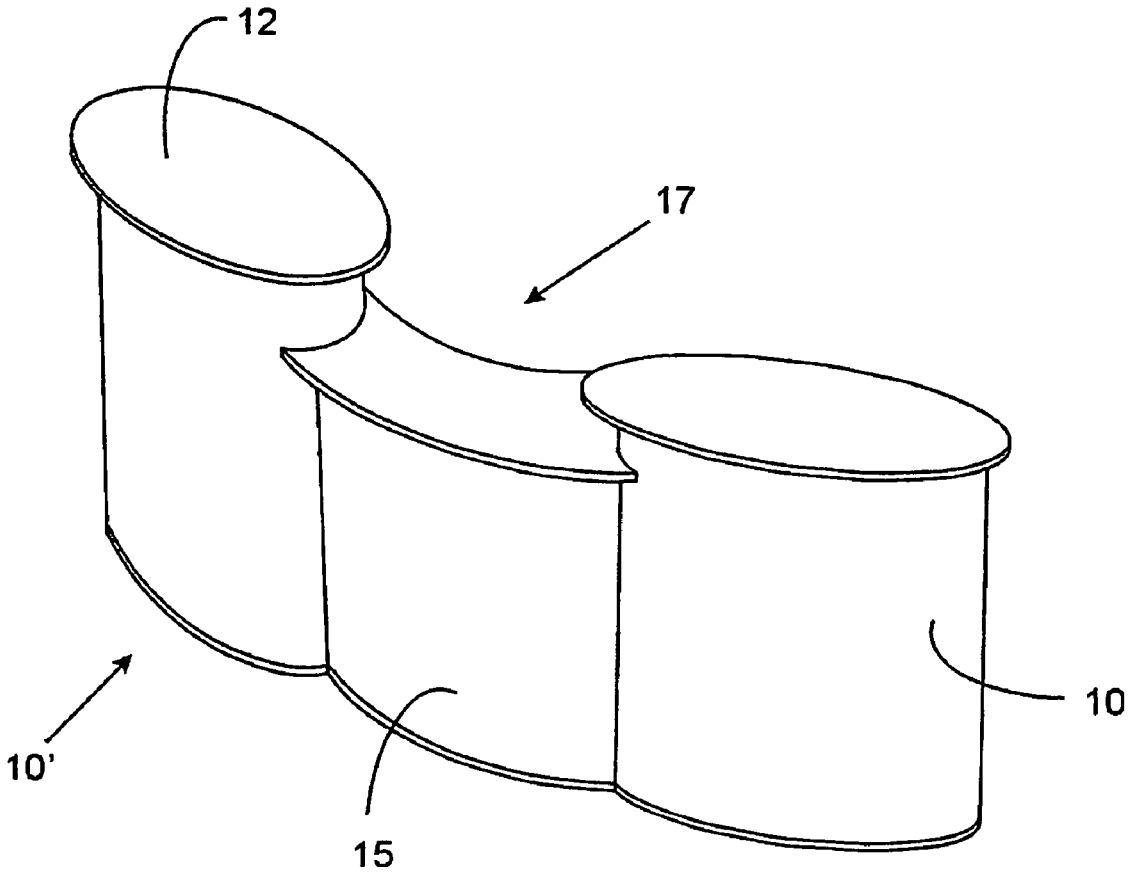
FIG. 20 is a perspective view of a exhibiting station and to attend customers according to the invention, teaching the use of a curved two-way connecting module as that illustrated in FIG. 13, to join two universal modules as those illustrated in FIG. 1, forming a simple exhibiting unit.

Two-way connecting modules 17 illustrated in FIGS. 13 and 14, allow to create simple basic exhibit stations as those illustrated in FIG. 19 or 20, or more complex exhibit stations based on said simple exhibit stations illustrated in FIG. 19 or 20.

Two-way connecting modules 17 (FIGS. 13 and 14) are different from three-way connecting modules 40 (FIG. 22) basically in the number of side walls. Indeed, while in two-way connecting module two side walls of material named as Tensaflex are used, in the three-way connecting module, three side walls are used.

Figure 22:
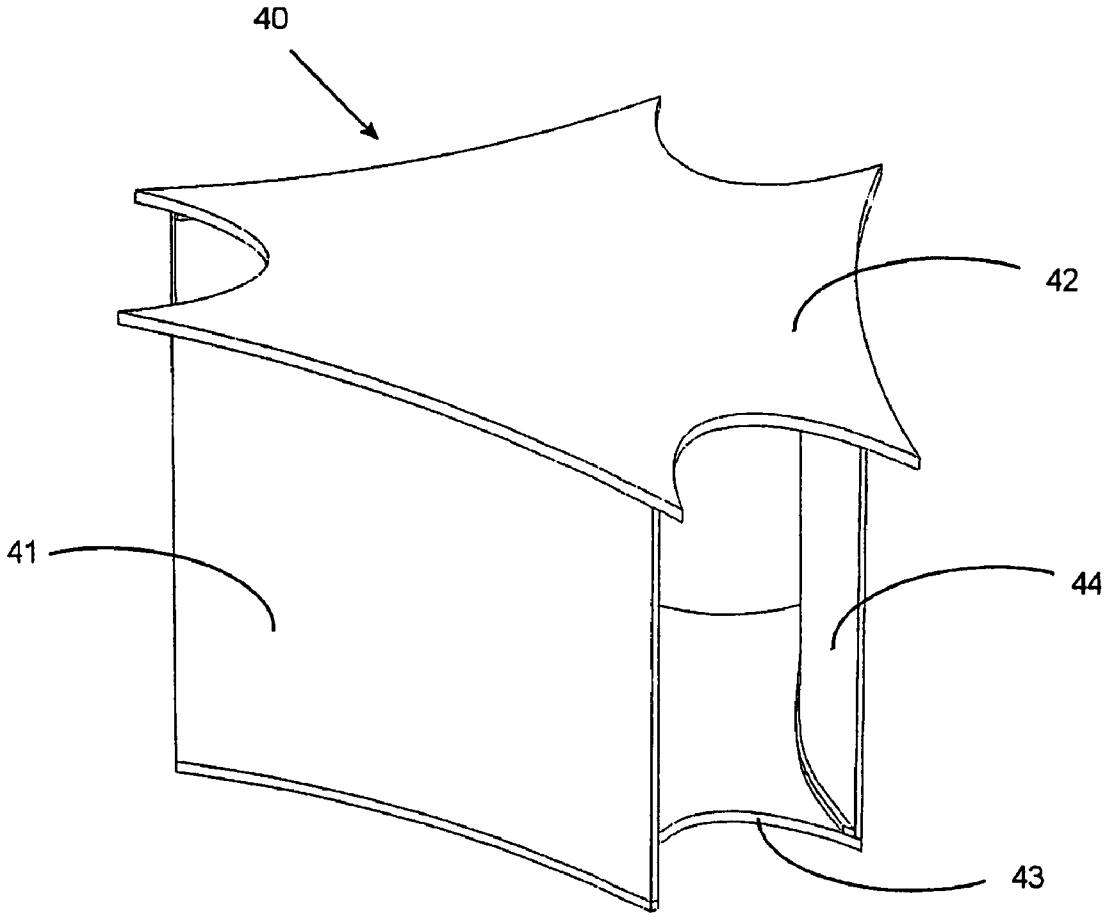
FIG. 22 is a perspective view showing a three-way connecting module used according to the invention, to provide a Y shape exhibiting unit.

A three-way connecting module 40 as that illustrated in FIG. 22, is formed by a cover lid board 42 and a base boards 43, both of irregular shape in way of triangle, that instead of vertices or tips, present some curvature arches which are formed and follow the same curvature of the side wall of universal modules 10' of the system of the present invention.

Along the opposite exterior longitudinal edges of the cover boars 42 of the three-way connecting module 40, there is a rabbet, on the vertical surface from which one of the Velcro strips is joined, that will cooperate with the other of the Velcro strips joined along the upper cross sectional edge of the partition wall of vertical side wall 41, constituted by the material designated, and already described as Tensaflex. In similar way, along the three higher sides of the board 43 there is a rabbet on the vertical surface from which one of the Velcro strips is joined, that cooperate with a Velcro strip arranged along the inferior cross sectional edge of the board of material Tensaflex, forming the vertical side wall 41 of said three-way connecting module 40.

Figure 23:
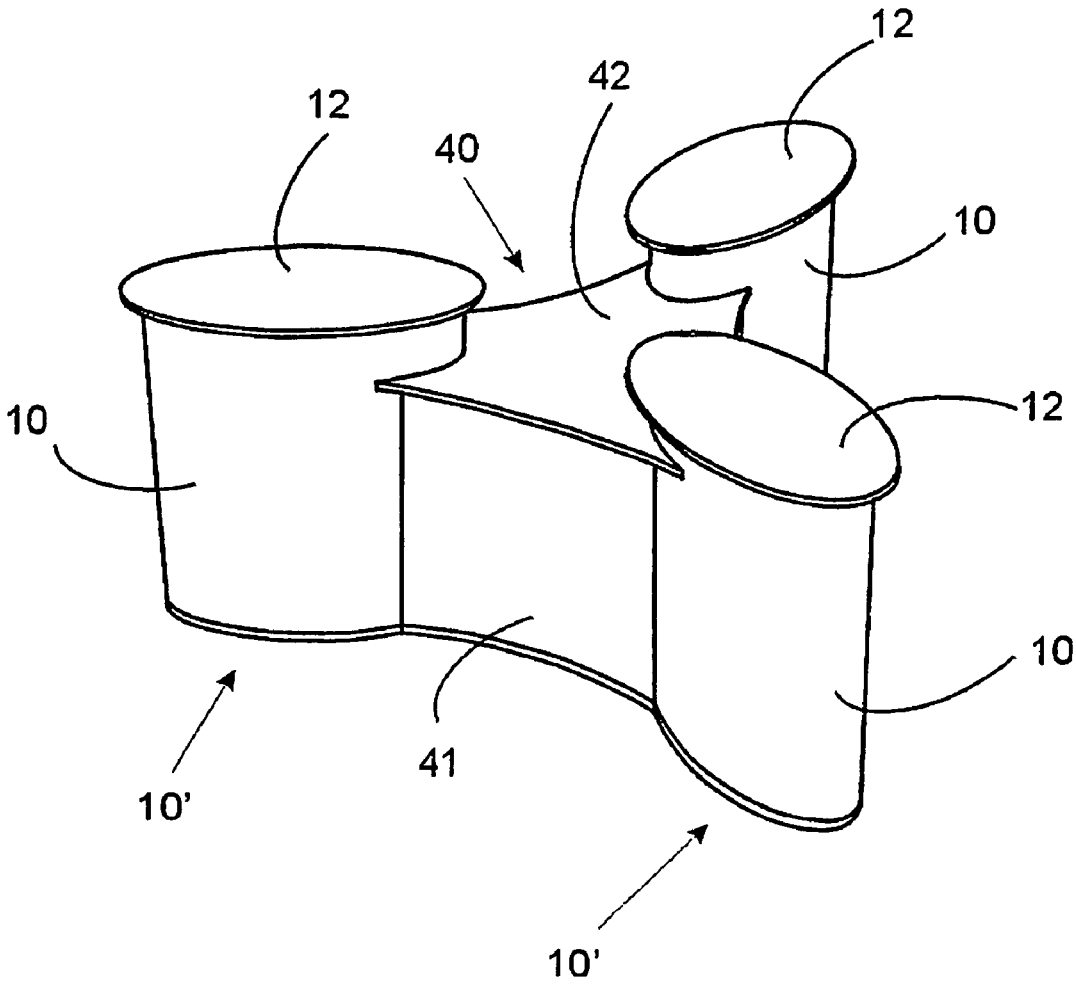
FIG. 23 is a perspective view of a exhibit station and to attend customers according to the invention, teaching the use of a three-way connecting module as that illustrated in FIG. 22, to join three basic units as those illustrated in FIG. 1, forming a Y shape exhibiting unit.

Three-way connecting modules 40 illustrated in FIG. 22, allow to create basic exhibit stations with "Y" shape as that illustrated in FIG. 23, or more complex exhibit stations based on the basic exhibit station with "Y" shape.

Alternatively, universal modules, as well as connecting modules, and in general any element making part of the system of the present invention, may use for assembling signals or guide points, as those indicated with the reference number 44 in FIG. 22, on the cover boards, base boards and side wall indicating the user the most appropriate way to join the different pieces of the units and modules integrating the system of the present invention.

As indicated before, to form the exhibit stations of the stations system of the present invention, there are used as basic elements, above mentioned universal modules and connecting modules. To achieve this objective, side walls of two, three or more ways connecting modules have a vertical band of Velcro in their ends, which allow to join in detachable way, connecting modules to the textile cloth that is in the exterior surface of the side walls of the universal modules. By alternating connecting modules between the universal modules, an user may create a plurality of designs and shapes of exhibit stations which goes from a simple set composed by two universal modules and a two-way connecting modules joining said universal modules, to much more complex exhibit stations that use several universal modules joined by straight or curved, two-way or three-way or more ways connecting modules, forming circular, elliptical, rectangular and Y stations, and any other type of exhibit station that the user desires, including stations with ear modules as those described below.

Figure 24:
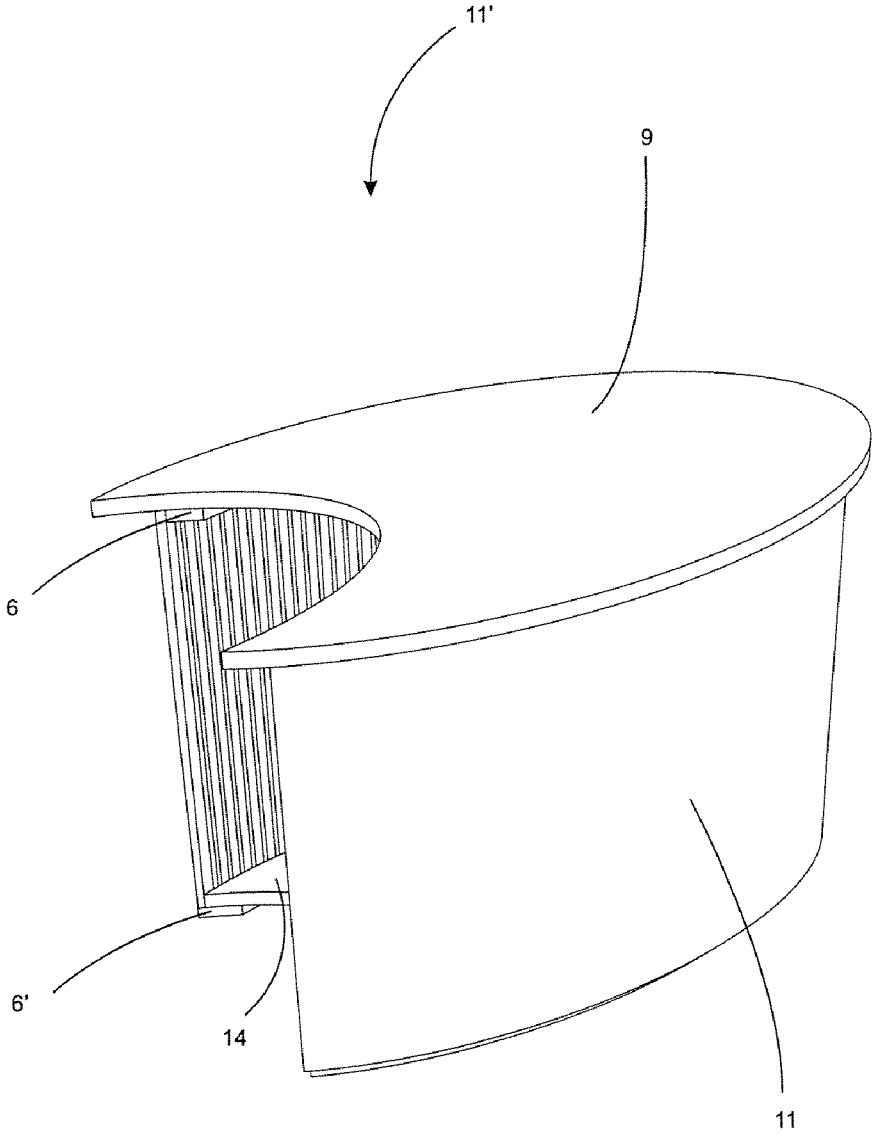
FIG. 24 is a perspective view of a era module useful to provide a exhibit station and attend customers according to the mode of the invention envisaging additionally to the connector module, the use of said ear modules with universal modules in an exhibiting station as those illustrated in FIG. 19, 20, 21 or 23.
Figure 25:
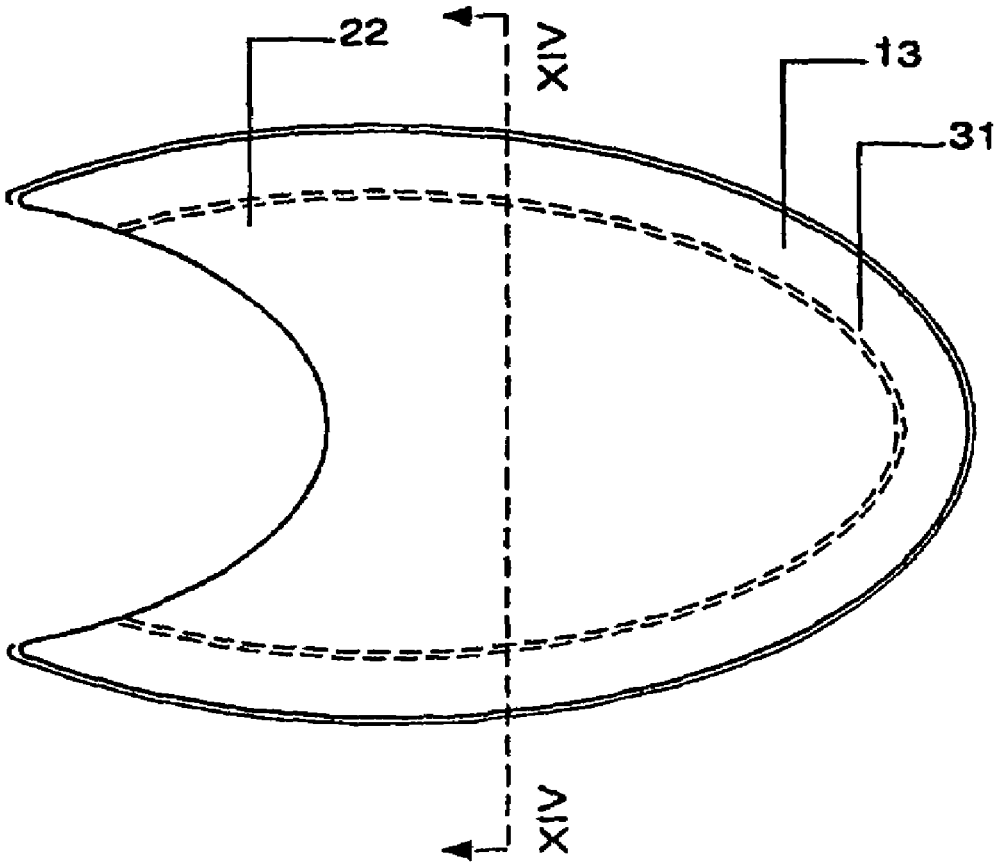
FIG. 25 is a plant view of the cover board of an ear module as that illustrated in FIG. 24, useful to be installed in an exhibit station and to attend customers, including universal modules and one or more connecting modules.
Figure 26:
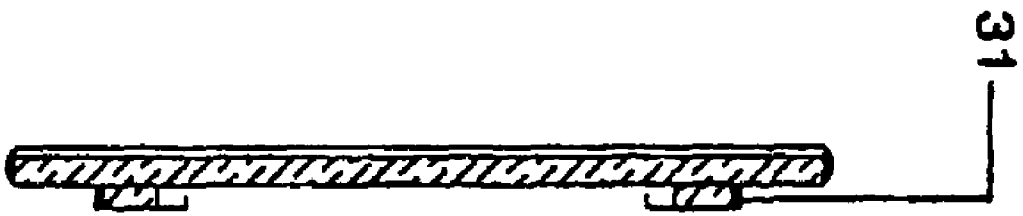
FIG. 26 is a vertical view, taken along XIV-XIV view, of the cover board illustrated in FIG. 25.
Figure 27:
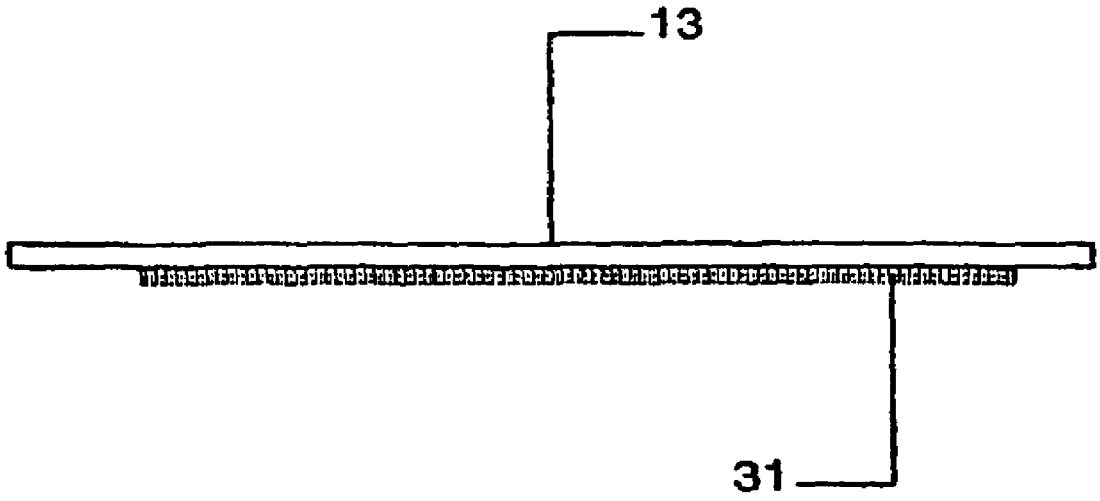
FIG. 27 is a vertical rising view of the cover board illustrated in the plant view in FIG. 25.
Figure 28:
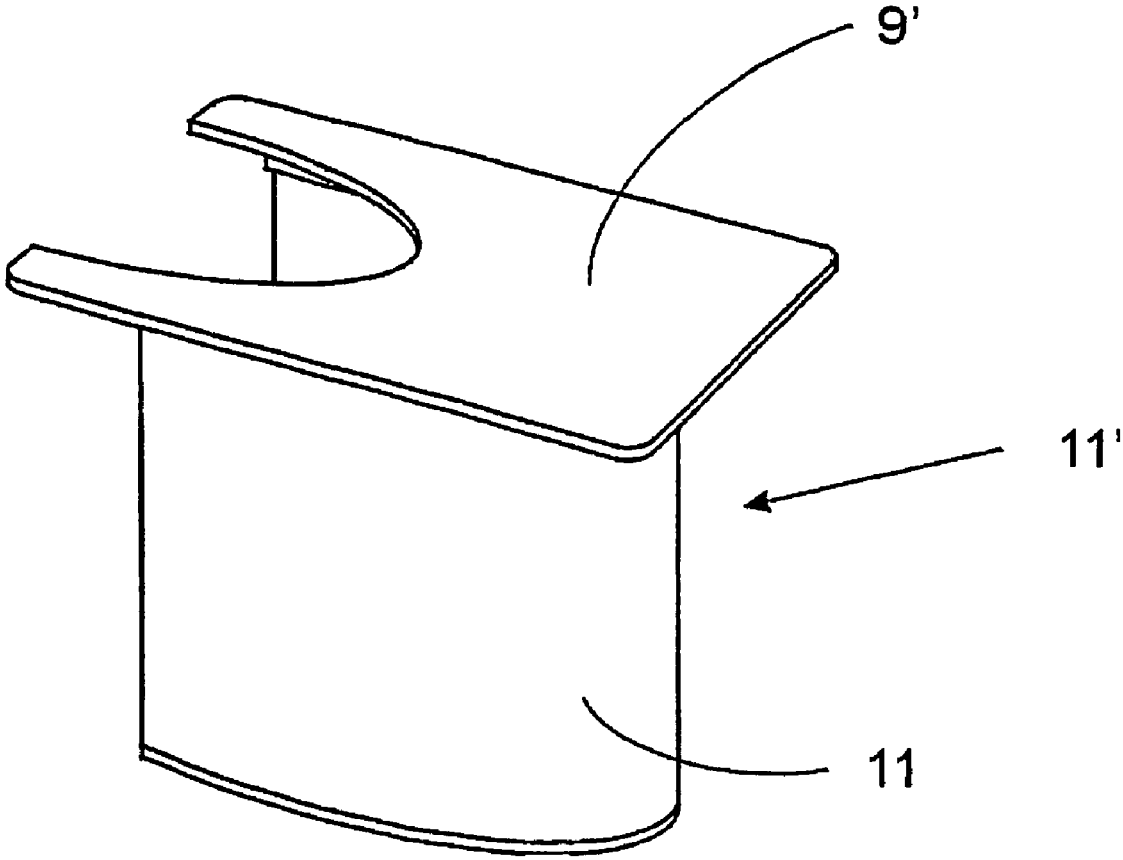
FIG. 28 is a perspective view of an ear module as that illustrated in FIG. 24, useful to be installed in an exhibit station and to attend customers according to the invention; which lid or cover is of rectangular shape.
Figure 29:
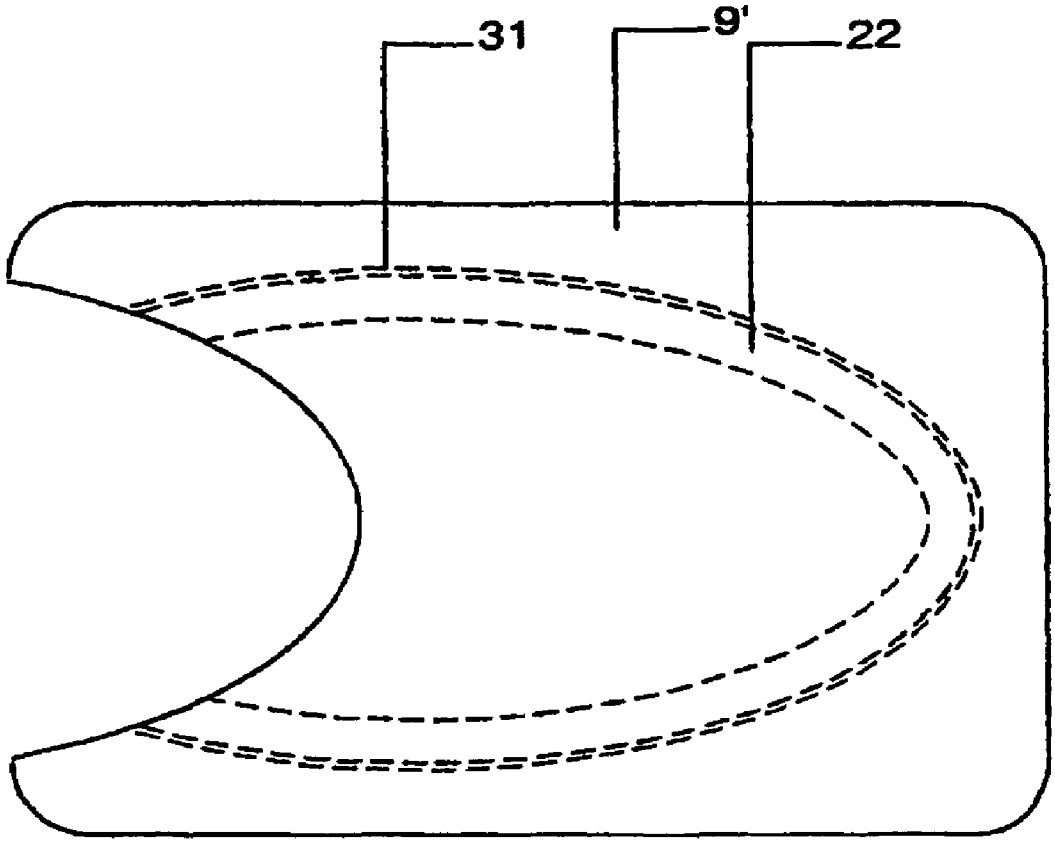
FIG. 29 is a plant view of the rectangular cover of the ear module illustrated in FIG. 28 to install an exhibit station, and to attend customers according to the invention.
Figure 30:
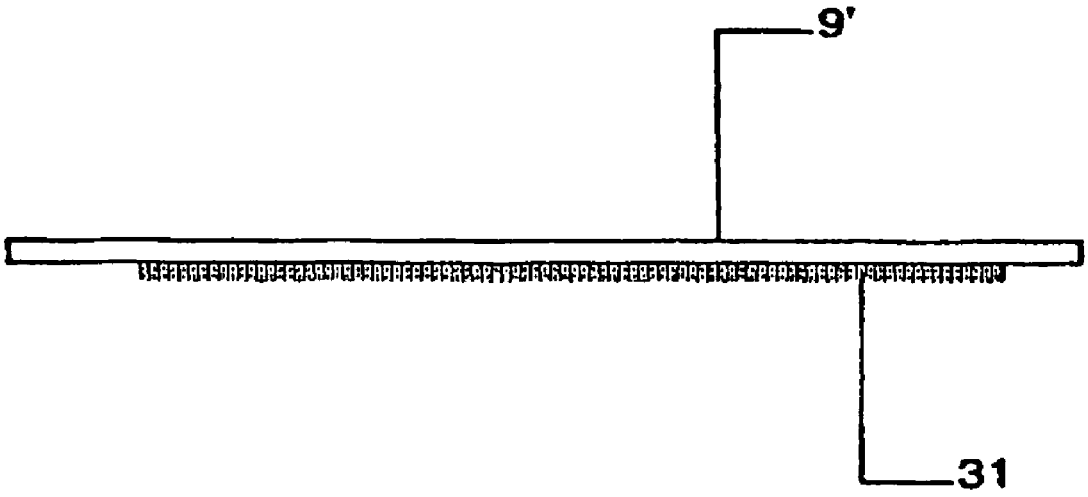
FIG. 30 is a vertical rising view of the rectangular cover showed in FIG. 29.
Figure 31:
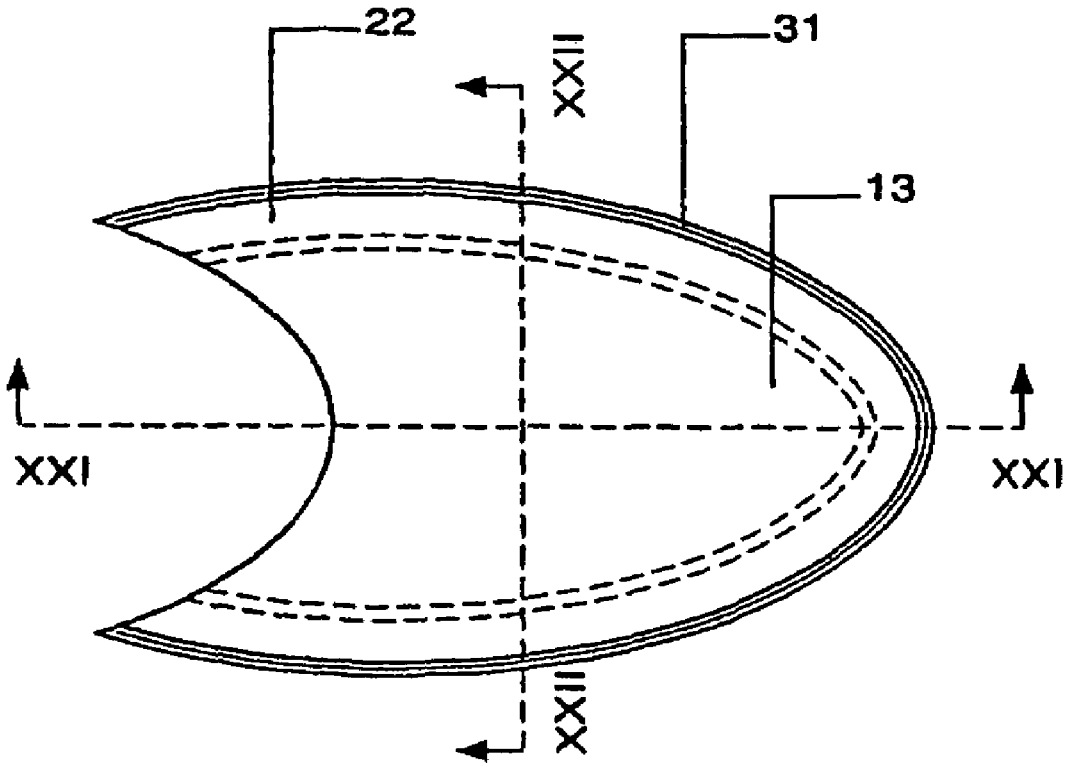
FIG. 31 is a plant view of the base board of the ear module illustrated in FIG. 24.
Figure 32:
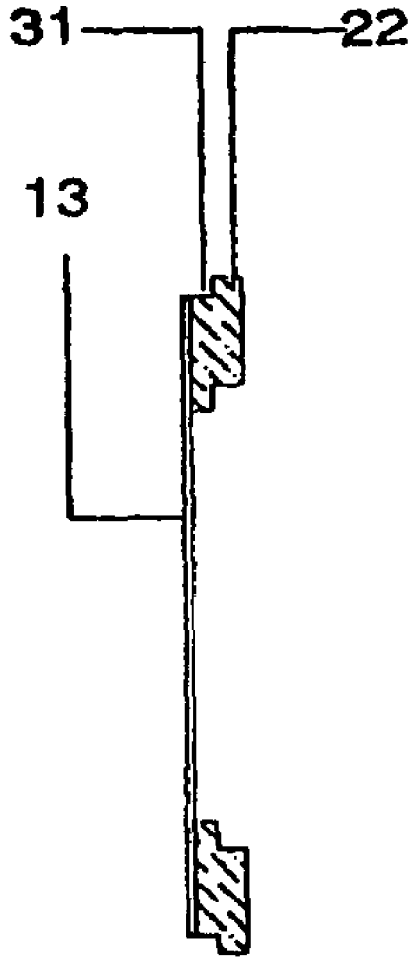
FIG. 32 is a longitudinal view, taken along the XXI-XXI line in FIG. 31.
Figure 33:
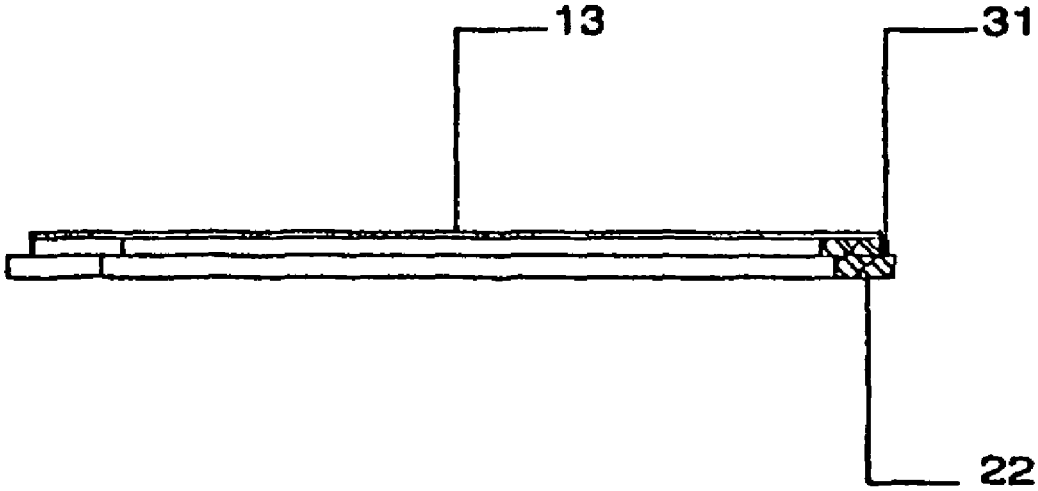
FIG. 33 is a cross section view, taken along the XXII-XXII line in FIG. 31.
Figure 34:
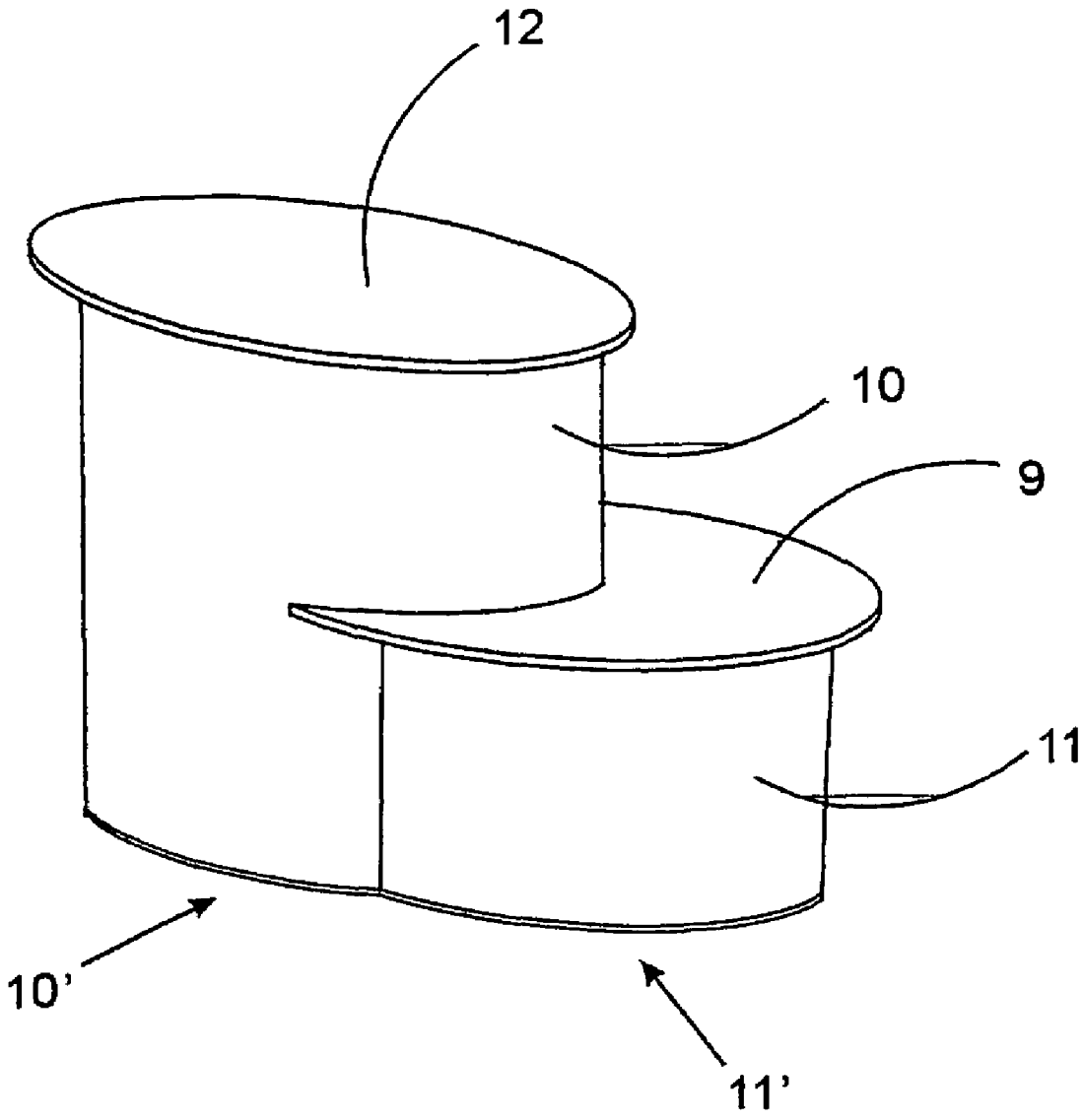
FIG. 34 is a perspective view of an exhibit station and to attend customers according to the invention, teaching the use of an ear module as that illustrated in FIG. 24, when it is attached to a universal module as that illustrated in FIG. 1, forming a simple exhibit station.

The exhibit stations system of the present invention also envisages, in one of their modes, the provision of means to extend, either in straight line or arched line, universal modules 10' in the formed exhibit stations, as observed in example in FIGS. 34 and 35. Thus, in example, to provide an exhibit station with their units 10' in straight line, the present invention envisages to install ear modules 11', FIGS. 24 and 34, consisting on units formed by a cover lid board 9 (FIGS. 25, 26, 27 and 34), which is essentially a general elliptic contour board, having in its marginal border a ledge 6, and having in one of their ends a rabbet area according to a curvature arch 7, which is developed according to a curvature arch that is adapted to be formed to the curvature arch of the end zone of the side wall of the basic unit 10'. Ear module 11', may be provided alternatively of a cover or cover board 9' of rectangular shape, as illustrated in FIGS. 28, 29, 30 and 35. Also, ear module 11' is provided of a rigid bottom board 14, (FIGS. 24, 31, 32 and 33), having in its side region of edge, supported on a ledge 6' projected vertically toward the inside of it. Vertical wall 11 of the ear module 11' is formed by a laminar section of above described material Tensaflex (FIG. 2). Height of ear module 11' diminishes preferentially progressively as each module is installed far from said universal module 10' which is in the exhibit station formed with the system of the present invention. Ear modules 11' are generally joined to a universal module 10' as illustrated in FIGS. 34 and 35, but also they may be joined each other by two-way, three-way or more way connecting modules as those described before.

Vertical wall 11 of the ear module 11' is joined, both to the cover board 9 and the bottom board 14', by Velcro unions made by cooperating Velcro strips 32 installed in faced way as well in regions of cross sectional, upper and inferior edge, of the partition wall of material Tensaflex 30 forming the vertical wall 11, as in appropriate places of both cover 9 and bottom 14' boards.

Ear modules 11' may be used in any type of exhibit station formed with the system of the present invention, including those using two-way, straight or curved connecting modules or three-way or more way modules.

As indicated before, the dismountable, ultra light stations systems to exhibit items and attend customers of the present invention, also comprises multiple exhibiting applications, which are selected from the group consisting of showcase modules; light modules to place advertisement or similar objects that may be lighted; parasols; advertisement pennants; CD exhibitors; books exhibitors; diverse item exhibitors; perforated and non perforated trays holding each other or that are slopped by a supporting element joined to the tray by a hinge; being these multiple exhibiting applications placed only on the flat cover of the universal module, of the connector module or the ear module, or being these multiple exhibiting applications supported on the modified cover of the universal module, from the connecting module or the ear module, or on the cover of another multiple exhibiting application, that may exhibit grooves, Velcro strips or similar adaptations.

Figure 36:
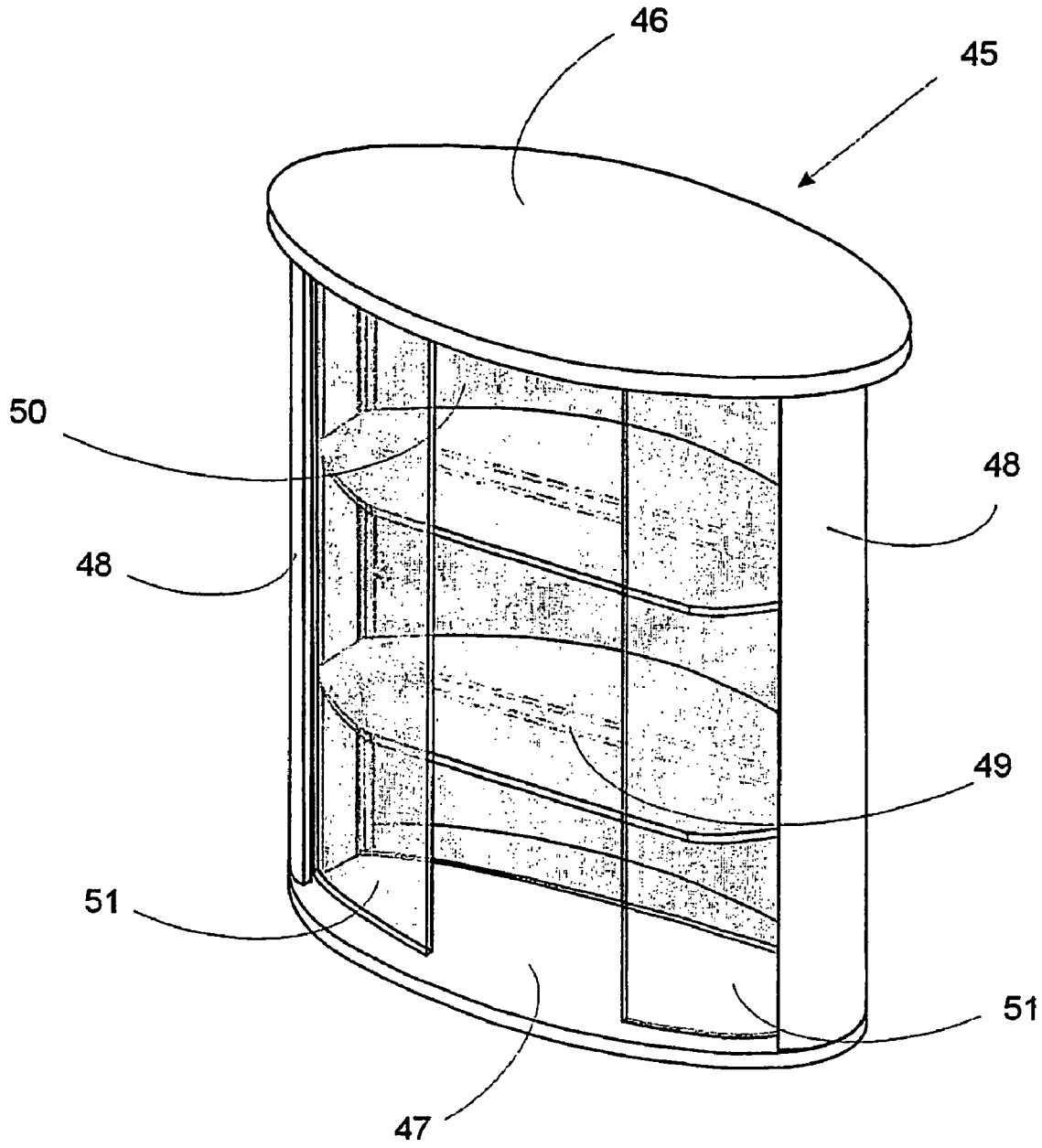
FIG. 36 is a perspective view of a showcase module acting as one of the multiple exhibiting applications making part of the system of the present invention.

One of the multiple exhibiting applications making part of the system of the present invention, consists on a showcase module indicated with the reference number 45 in FIG. 36. Said showcase module 45 has a vertical body for deposit of general elliptic shape cross section, which is provided of a cover lid 46 and, vertically separated of it, from a base board 47, being provided the upper surface of said base board, toward the center and around its external edges, of a groove receiving two side beams 48 as posts, which have grooves adapted to receive one, two or more shelve boards 49 of transparent material, each with a separator (non illustrated in FIG. 36), located under each shelf, to provide stability to the structure of the shelf, and an upper beam (non illustrated in FIG. 36), joining the two beams to give stability to the structure and to support the cover lid 46 of the showcase module 45 to which it is joined by a Velcro type union, having said showcase module a frontal panel 50 of transparent material, and two posterior panels 51 of transparent material matching in the groove of the base board, being said posterior panels separated each other to define a door opening.

Showcase module 45 illustrated in FIG. 36, may additionally include a door installed by conventional means, in the door openings giving access to the internal storage space of the showcase module.

Figure 37:
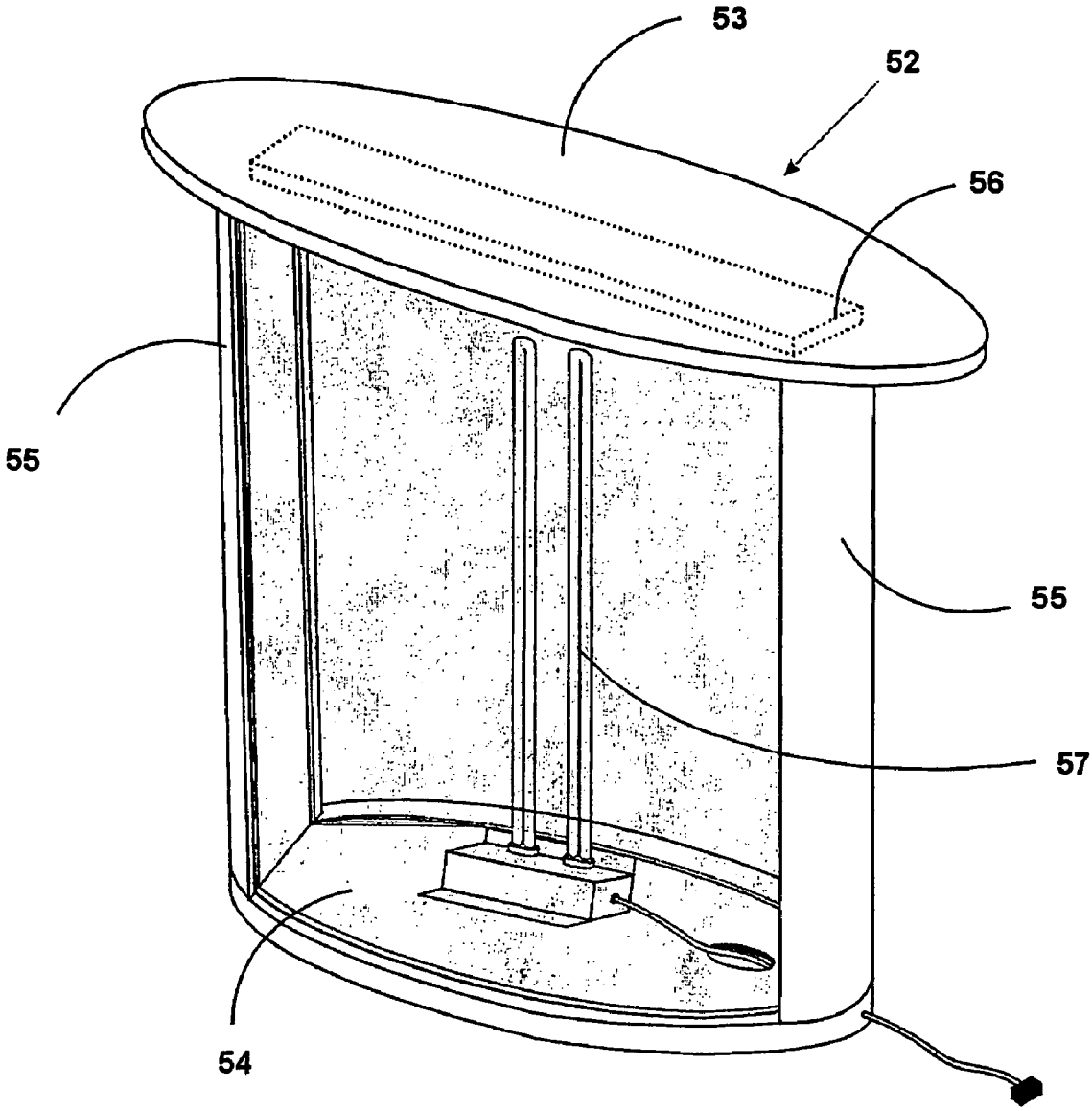
FIG. 37 is a perspective view of a preferred mode of a light module acting as one of the multiple exhibiting applications making part of the system of the present invention.
Figure 38:
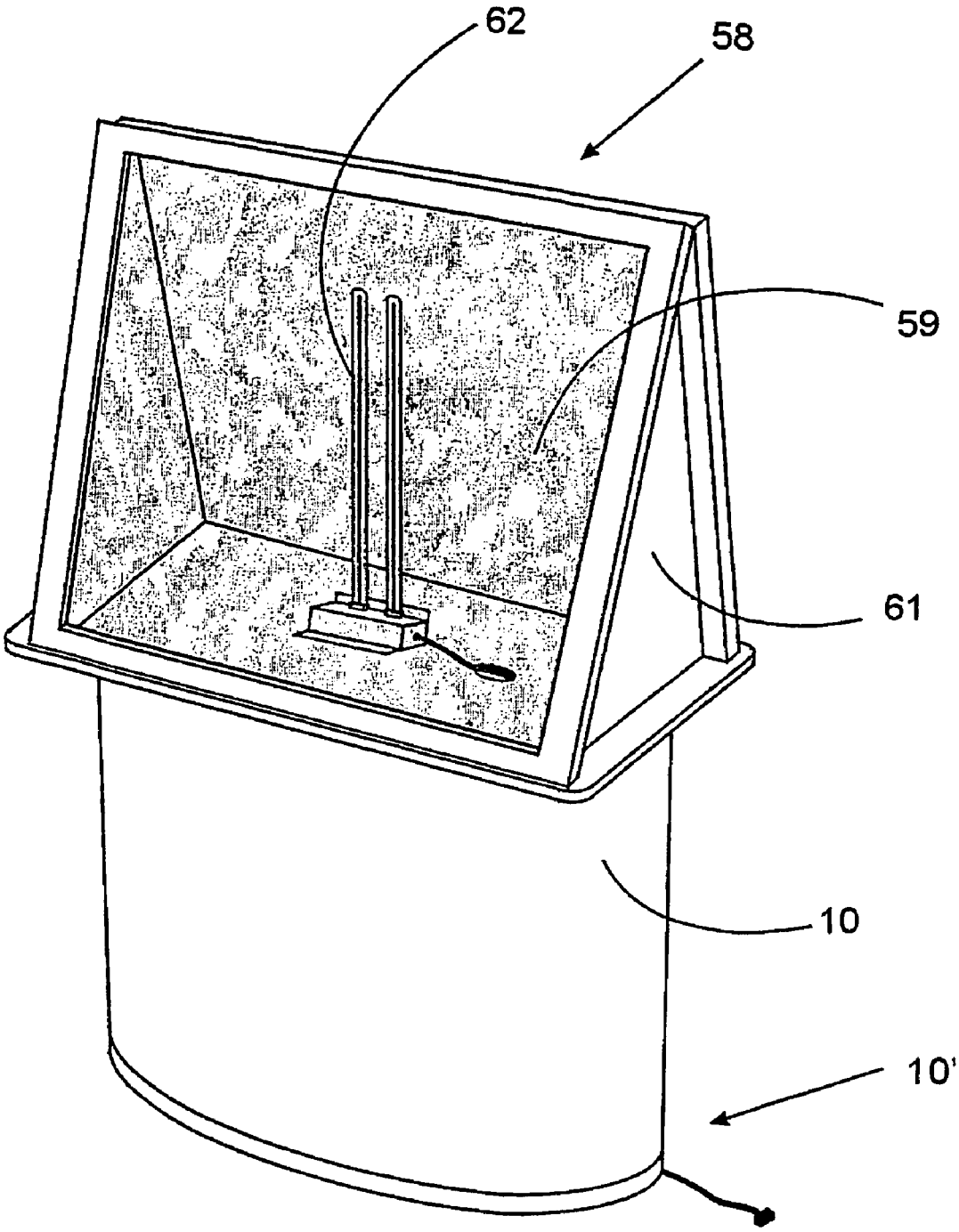
FIG. 38 is a perspective view of a another preferred mode of a light module acting as one of the multiple exhibiting applications making part of the system of the present invention.
Figure 39:
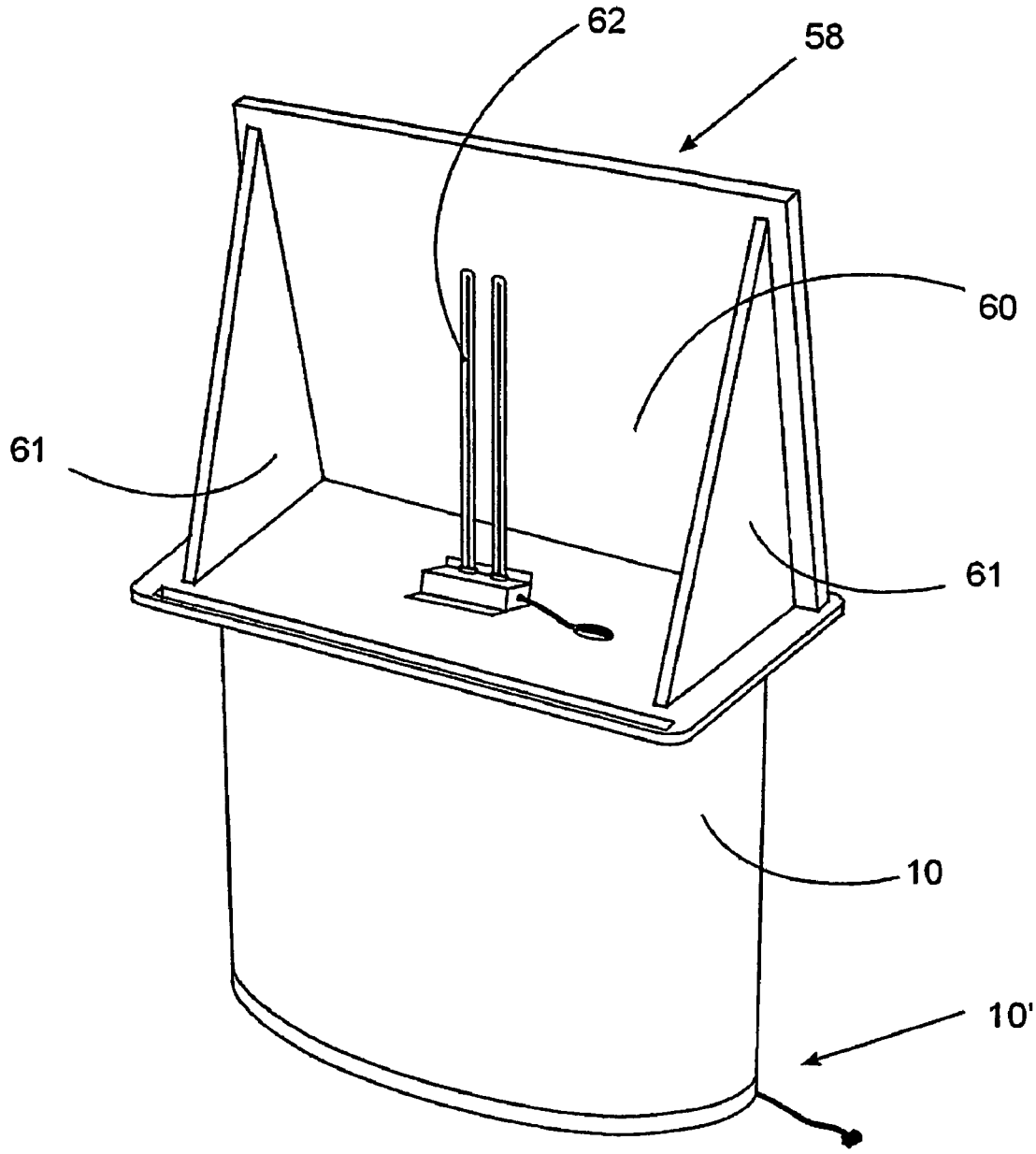
FIG. 39 is a perspective view of the light module illustrated in FIG. 38 without frontal panel, and showing internal bulbs.

Another of the multiple exhibiting applications making part of the system of the present invention consists on a light module as those illustrated in FIGS. 37, 38 and 39. Light module 52 illustrated in FIG. 37 has a vertical body of deposit of general elliptic shape cross section, which is provided of a cover lid 53 and, vertically separated from it, of a base board 54, having the upper surface of said base board 54, toward the center and around its external edges, a groove receiving two side beams 55 in way of posts, joined in the upper part by a beam 56 giving stability to the structure and supporting the cover lid 53 of the light module 52 to which it is attached by a Velcro type union or any other type of union, being said base board also adapted to install one or more bulbs 57 or similar objects, and having said light module a frontal panel and a posterior panel, both of transparent material matching in the groove of the base board and allowing to place any type of advertisement or similar objects that may be lighted.

Another mode of before described light. module is appreciated in FIGS. 38 and 38, wherein the base of said module 58 is composed by a universal module 10' as that described before, having its lid or upper cover of square type, and being the side wall of said module totally closed. This type of light module 58 has a structure to be matched in a groove, or that may be adhered to the rectangular lid or cover by a Velcro union strip. Said light module comprises a frontal panel 59 and a posterior panel 60, both or only one of them of transparent material, that are either supported by pressure executed each other, or they are joined in their upper part by a Velcro union strip. Also, two side panels 61 make part of this kind of light module, with shape of triangle supported by the frontal 59 and posterior 60 panels by the pressure executed on them, or adhered to said posterior 60 and frontal 59 panels by a Velcro type union. In the space formed by posterior 60 and frontal 59 panels, there are normally installed one or more bulbs 52 or similar objects, which allow to light an advertisement or similar object that may be lighted, and which is placed on one or two posterior and frontal panels.

Figure 40:
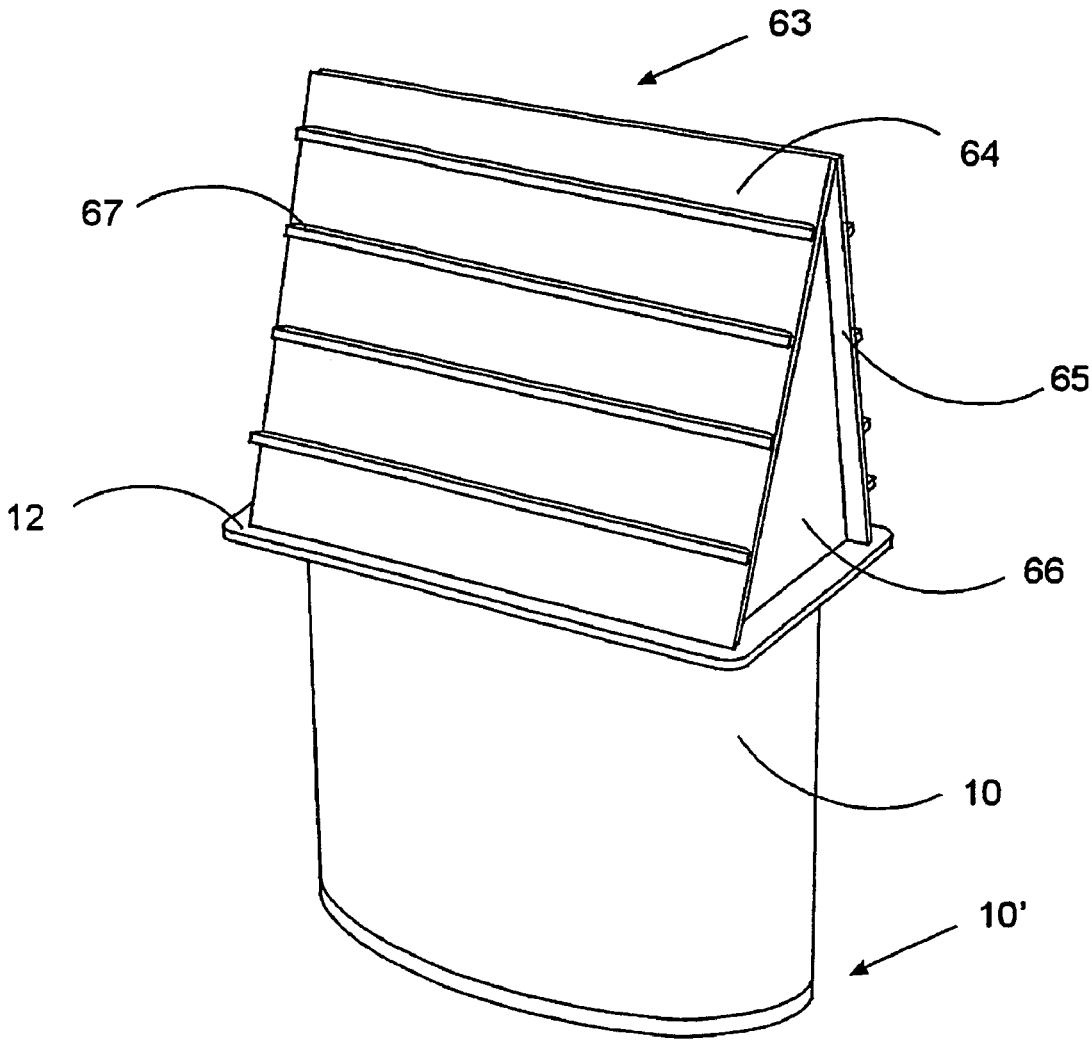
FIG. 40 is a perspective view of a CD's or similar objects exhibitor acting as one of the multiple exhibiting applications making part of the system of the present invention.
Figure 41:
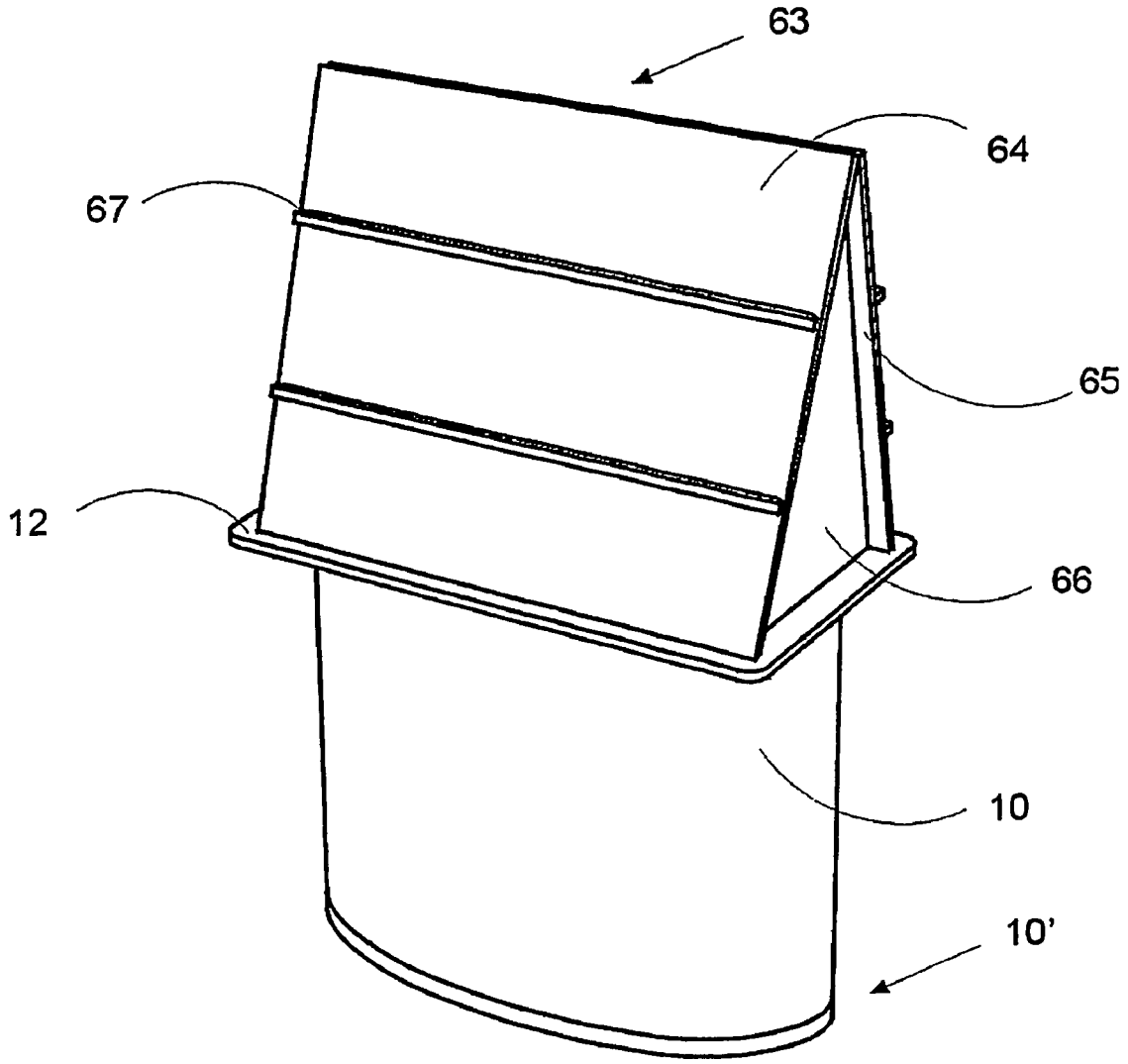
FIG. 41 is a perspective view of a book or similar objects exhibitor acting as one of the multiple exhibiting applications making part of the system of the present invention.
Figure 42:
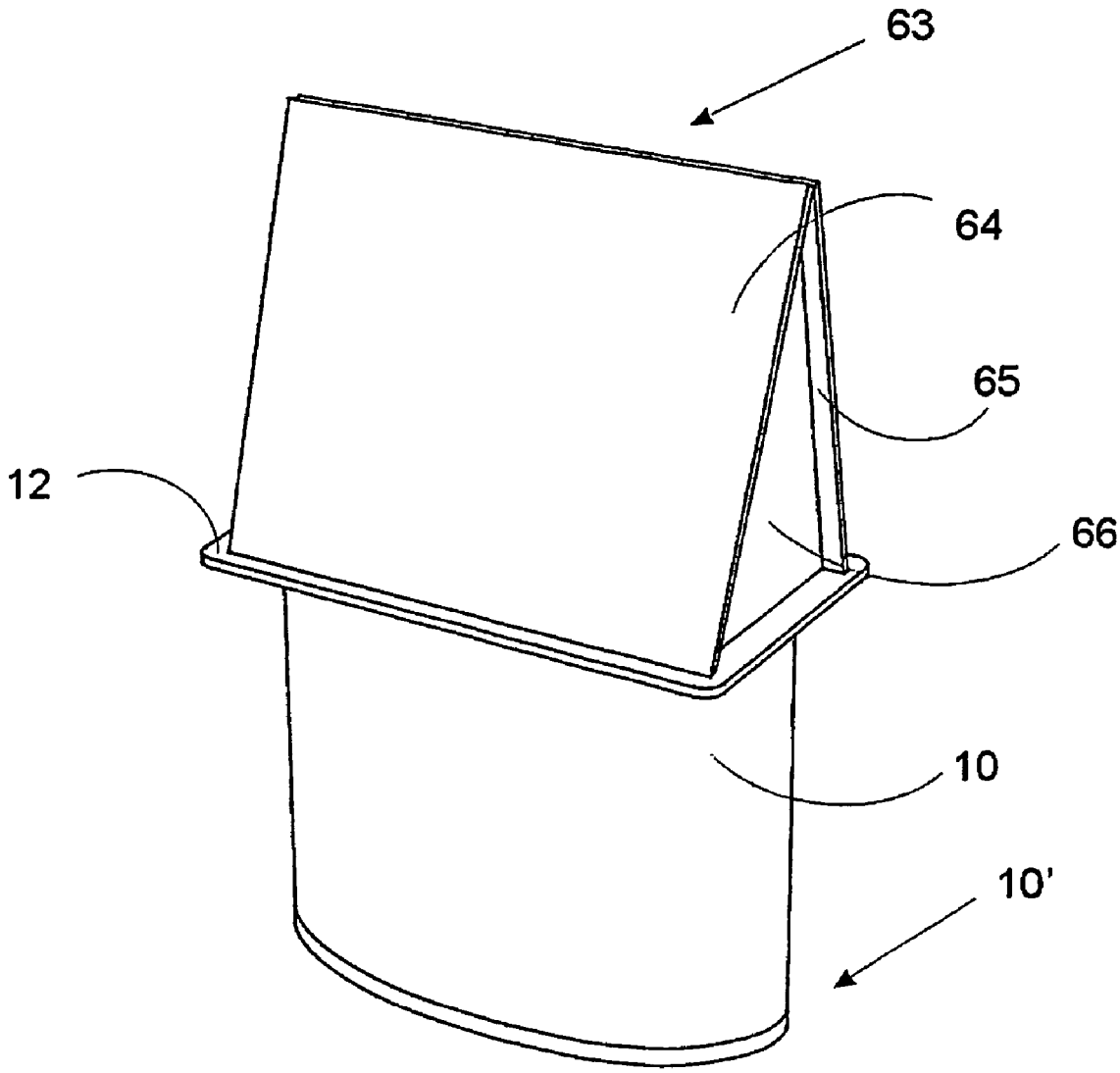
FIG. 42 is a perspective view of an item exhibitor acting as one of the multiple exhibiting applications making part of the system of the present invention, wherein frontal and posterior panels have a specially adapted cloth to receive items in exhibition.

An item exhibitor constitutes another of the multiple applications making part of the system of the present invention. An item exhibitor 63 such as CD's, illustrated in FIG. 40 has a structure that may be matched in a groove, or may be adhered to the lid or cover 12 of rectangular type of a described before universal module 10', by a union Velcro strip. This exhibitor 63 comprises a frontal panel 64 and a posterior panel 65 that are either supported by pressure executed each other, or they are joined in their upper part by a Velcro union strip. Said exhibitor 63 also includes two side panels 66 with shape of triangle supported by the frontal and posterior panels by the pressure executed on them, or be adhered by said posterior and frontal panels by a Velcro type union. Posterior and frontal panels of the exhibitor 63, illustrated in FIG. 40 have a series of shelves 67 allowing to support CD's or similar objects. Nevertheless, distance between said shelves 67 may be higher as in the case of exhibitor 63 illustrated in FIG. 41, to receive books or similar objects; or the exhibitor 63 may just not have shelves, but being constituted by a special cloth to which products to be exhibited are adhered, as in the case illustrated in FIG. 42.

Figure 43:
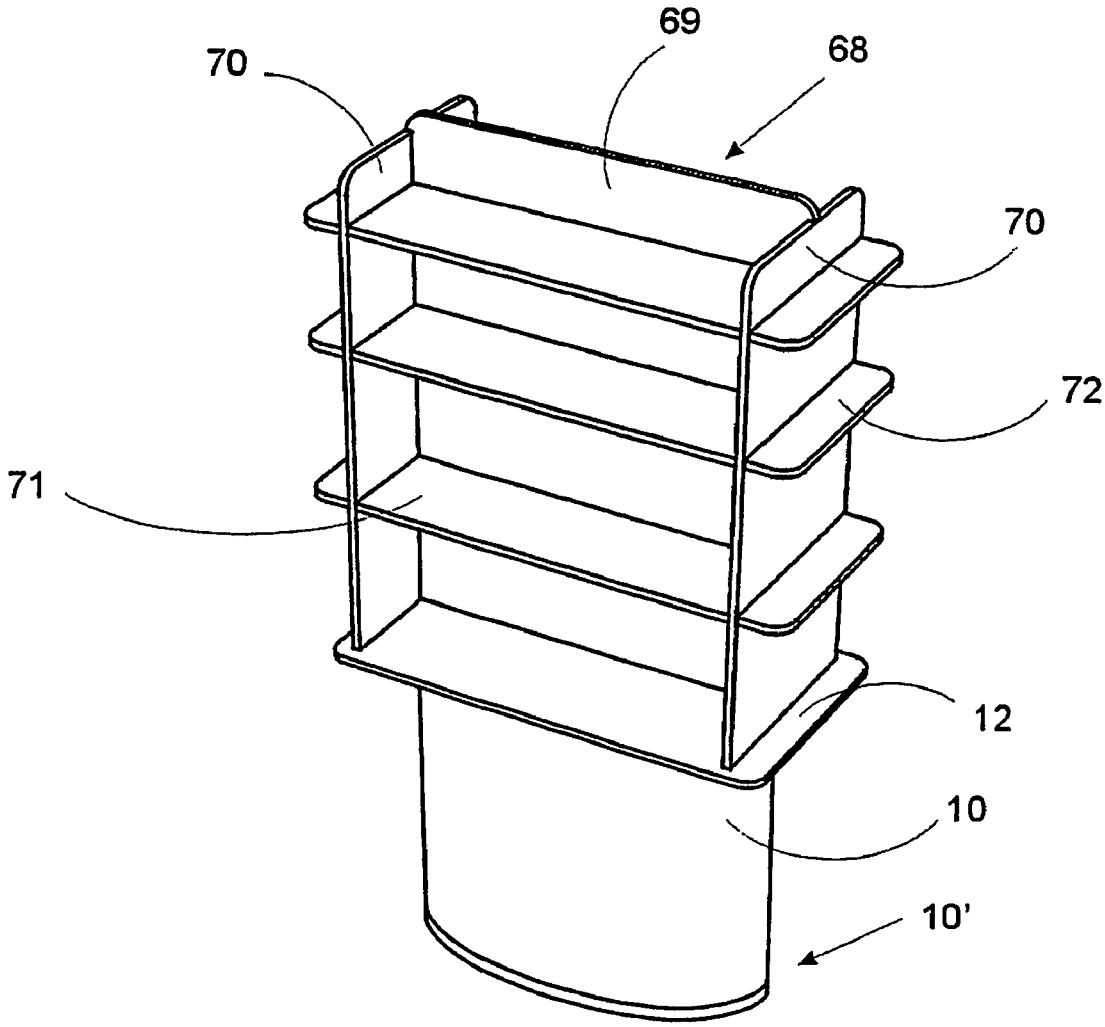
FIG. 43 is a perspective view of a diverse item exhibitor with a "H" shape structure, and acting as one of the multiple exhibiting applications making part of the system of the present invention.

Another multiple exhibiting application making part of the system of the present invention consists on a diverse items exhibitor 68 illustrated in FIG. 43 which has a structure that may be matched in a groove, or that may be adhered to the lid or cover 12 of rectangular type of a before described universal module 10', by a Velcro union strip. Said exhibitor 68 comprises a central panel 69 matching in the central vertical grooves of two side panels 70, forming a "H" shape structure from an upper view, and a plurality of shelves, matching in horizontal way corresponding grooves specially arranged in the interior part of side panels 70 to form a series of shelves to receive any type of items which adapt to the size of said shelves, having also, side panels a plurality of shelves 72 in their external part.

Figure 44:
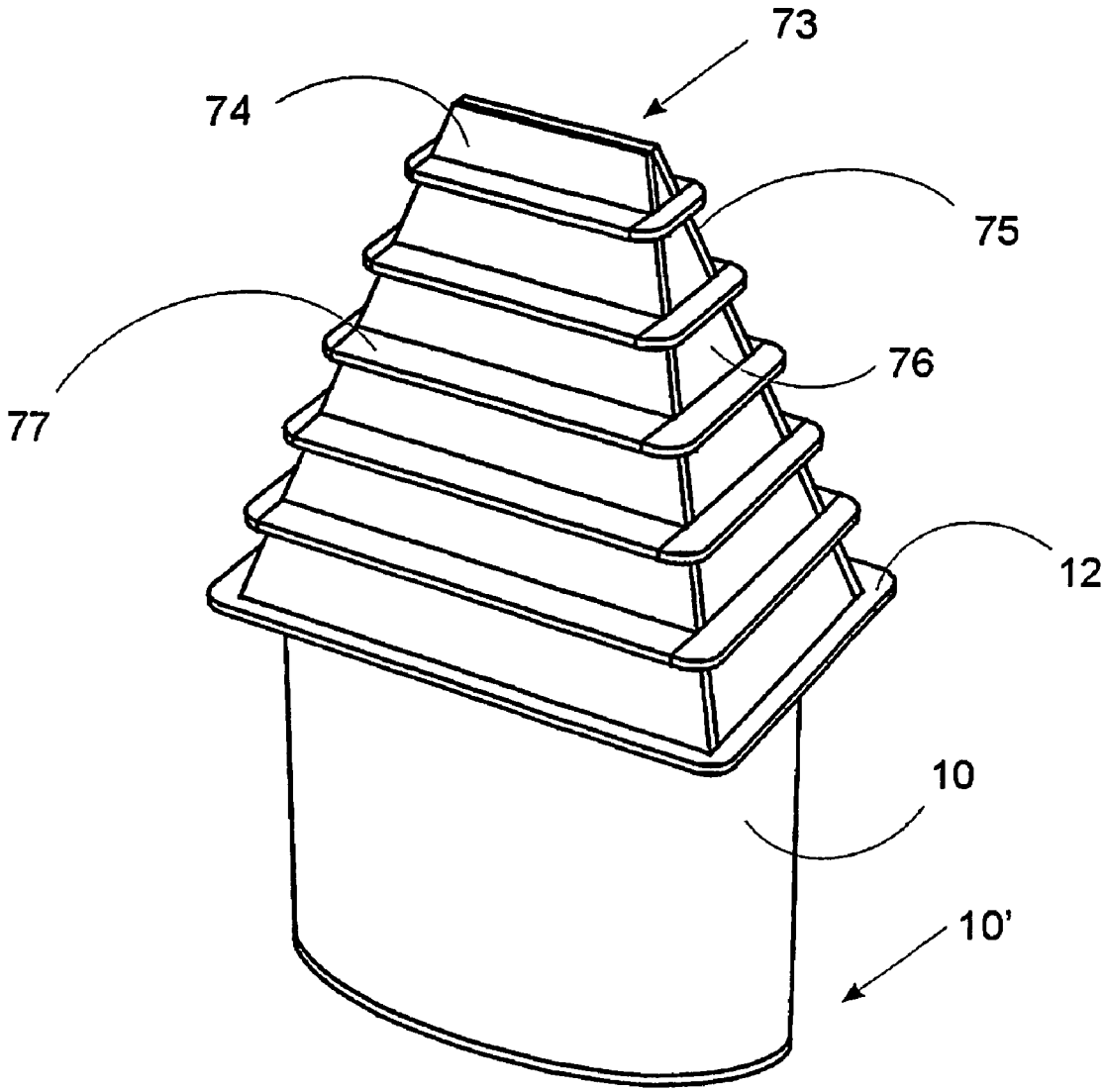
FIG. 44 is a perspective view of a diverse item exhibitor with a pyramidal structure, which acts as one of the multiple exhibiting applications making part of the system of the present invention.

Another mode of diverse items exhibitors is illustrated in FIG. 44. This diverse items exhibitor 73 has a pyramidal structure that may be matched in a grooves, or that may be adhered to the lid or cover 12 of rectangular type of a before described universal module 10', by a Velcro union strip. This exhibitor 73 comprises a frontal panel 74 and a posterior panel 75 of trapezoidal shape that are either supported by pressure executed each other, or they are joined in their upper part by a Velcro union strip. Said exhibitor 73 also includes two side panels 76 of shape of triangle supported by the frontal and posterior panels by the pressure executed on them, or adhered to said posterior and frontal panels by a Velcro type union. Posterior, frontal and side panels of exhibitor 73 illustrated in FIG. 44 have a series of shelves 77, totally surrounding the structure formed, and which allow to support any type of items adapted to the size of shelves formed by said shelves 77.

Figure 45:
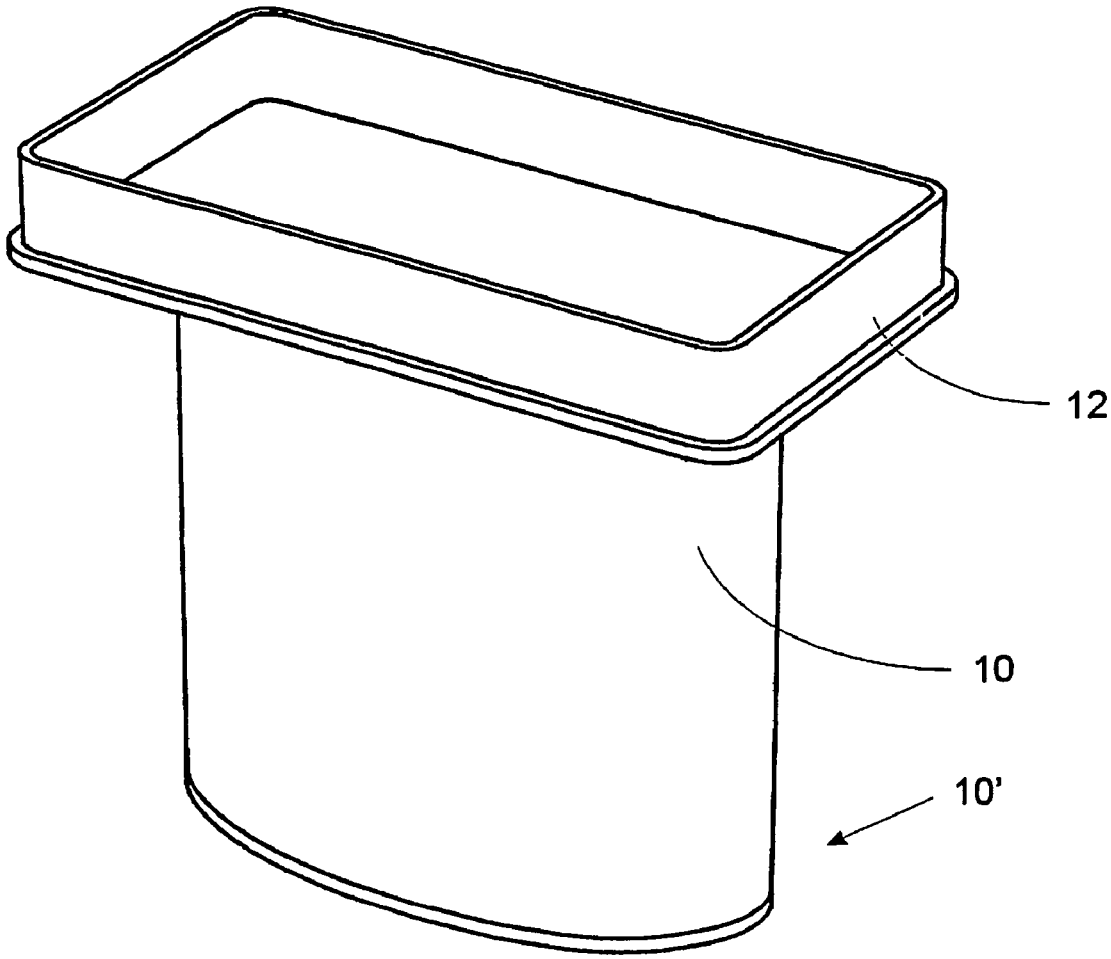
FIG. 45 is a perspective view of a exhibitor mode comprising a universal module as that illustrated in FIG. 1, wherein the lid or cover has been adapted in way of tray, and acting as one of the multiple exhibiting applications making part of the system of the present invention.
Figure 46:
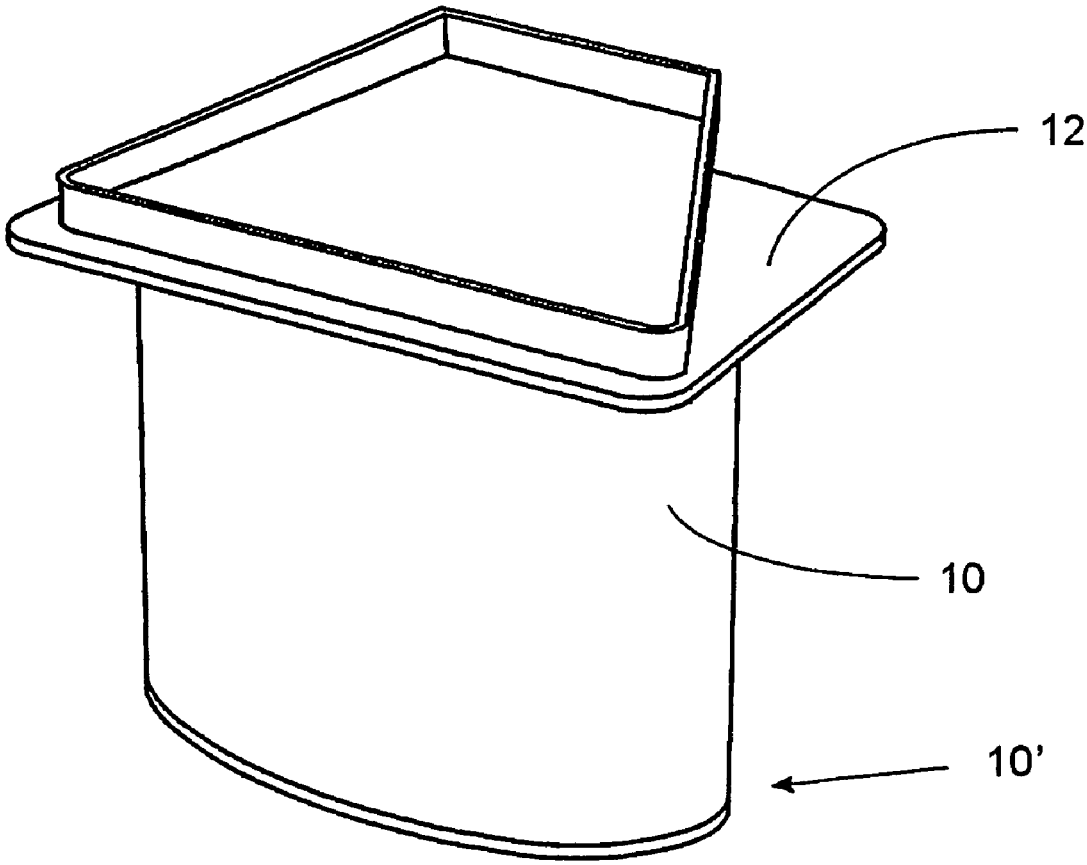
FIG. 46 is a perspective view of another exhibitor mode comprising an universal module as that illustrated in FIG. 1, wherein the lid or cover has been adapted in way of tray, and acting as one of the multiple exhibiting applications making part of the system of the present invention.
Figure 47:
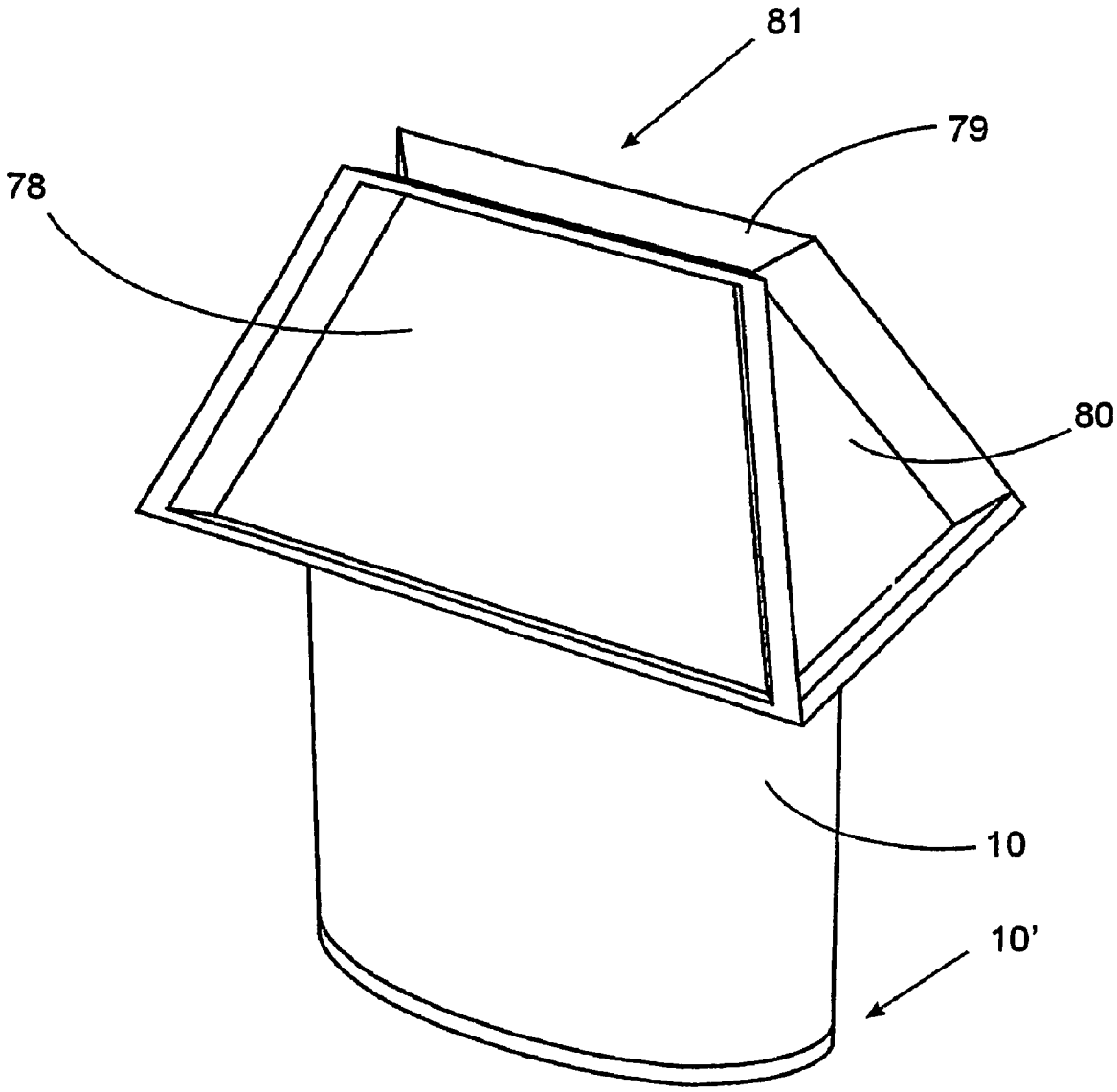
FIG. 47 is a perspective view of another mode of exhibitor comprising a posterior tray, a frontal tray and side trays located on a universal module as that illustrated in FIG. 1, wherein the lid or cover has been adapted to receive said trays, and acting as one of the multiple exhibiting applications making part of the system of the present invention.

Another multiple exhibiting application making part of the present invention consists on exhibitors composed by perforated or non perforated trays as those illustrated in FIGS. 45, 46 and 47. FIGS. 45 and 46, for example, illustrate a before described universal module 10', which lid or cover 12 has been adapted to the shape of a tray, being said tray of a size reaching the edge of the lid or cover 12 as in the case of the exhibitor illustrated in FIG. 45, or being said tray of a size lower than the size of the lid or cover 12.

This type of exhibitors composed by trays may also be a structure as that described in FIG. 47, which must be matched to a groove or may be adhered to the lid or cover 12 of rectangular type of the above described universal module 10', by a Velcro type union. This type of exhibitor 81 comprises a frontal tray 78, a posterior tray 79 and side trays 80 that are either supported by pressure executed each other, or they are joined by Velcro union strips, as illustrated in FIG. 47.

This type of exhibitors composed by trays may also be a structure (FIG. 46) composed by a sole tray which is slopped by a supporting element joined to said tray by a hinge that may be supported in a groove or that may be adhered to a specially arranged Velcro strip on the rectangular lid or cover of a universal module.

Figure 48:
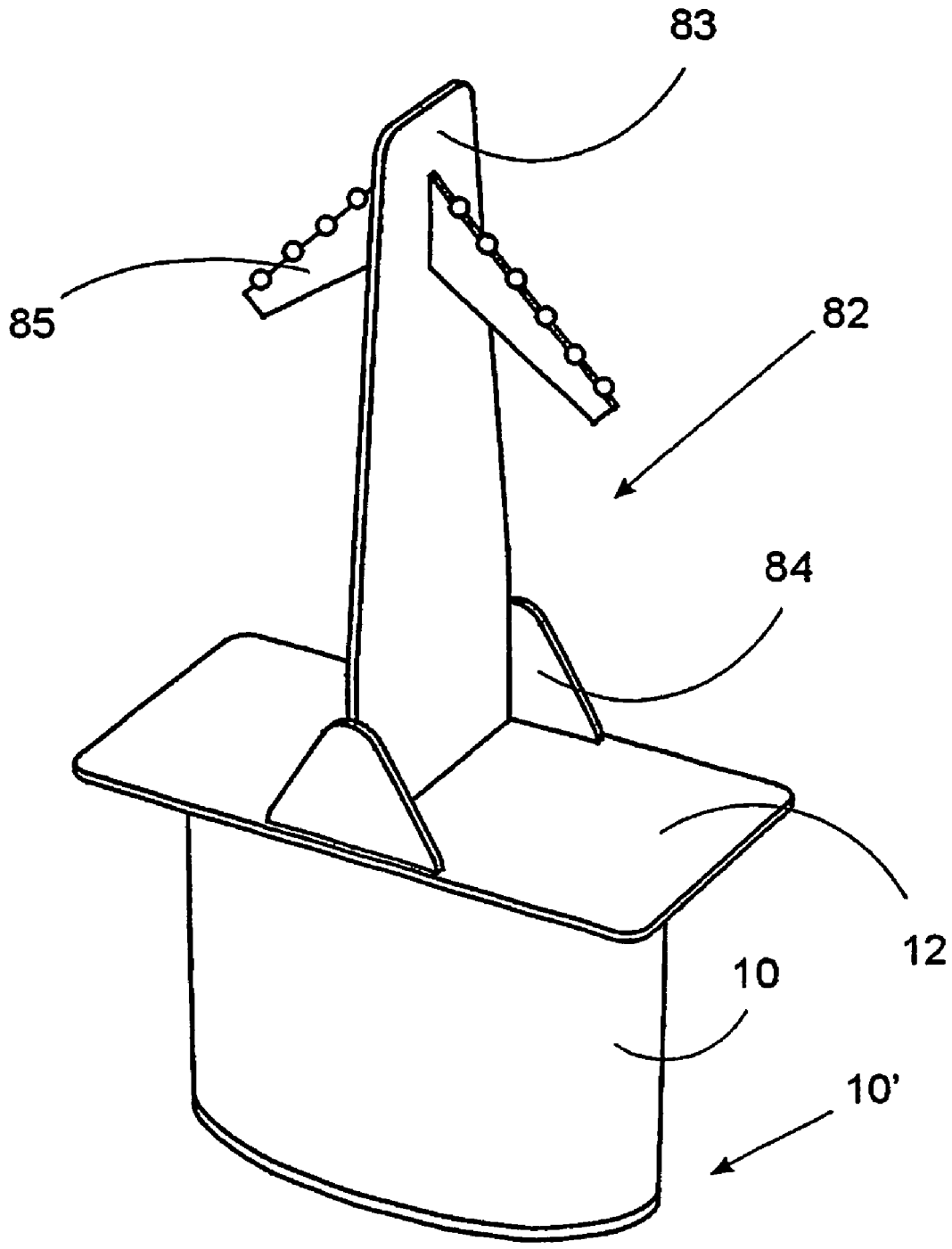
FIG. 48 is a perspective view of another mode of exhibitor comprising a universal module as that illustrated in FIG. 1, wherein the lid or cover has been adapted to receive in way of coat rack to support diverse type of clothing, and acting as one of the multiple exhibiting applications making part of the system of the present invention.

Another multiple exhibiting application making part of the system of the present invention consists on a clothing exhibitor 82 illustrated in FIG. 48 and which has a structure in way of coat rack that may be matched in a groove or that may be adhered to the lid or cover 12 of rectangular type of an above described universal module 10', by a Velcro union strip. Said clothing exhibitor 82 comprises a central panel 83, two triangle shape panels 84 and two beams 85, that when they are joined form a structure in way of coat rack allowing to receive clothing on beams 85.

Figure 49:
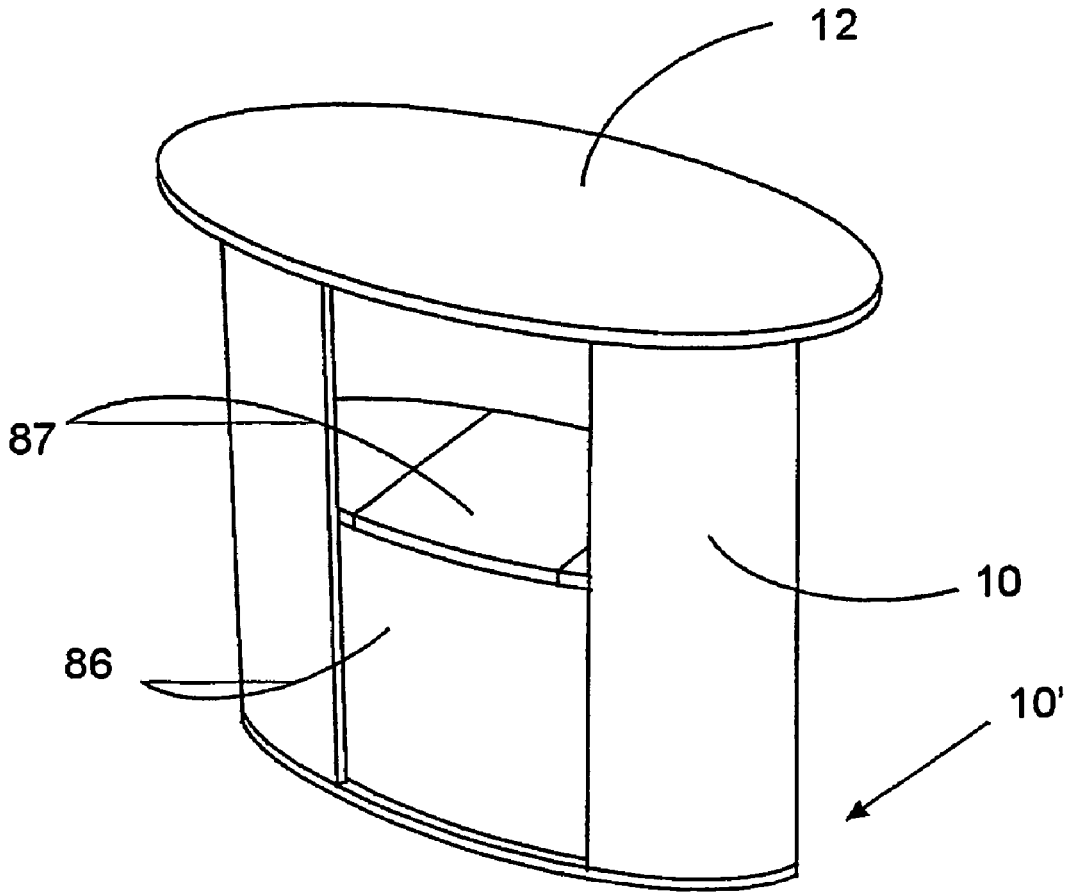
FIG. 49 is a perspective view of another mode of multiple exhibiting application comprising a universal module as that illustrated in FIG. 1, in which internal space there has been arranged a polystyrene refrigerator, and which acts as one of the multiple exhibiting applications making part of the system of the present invention.
Figure 50:
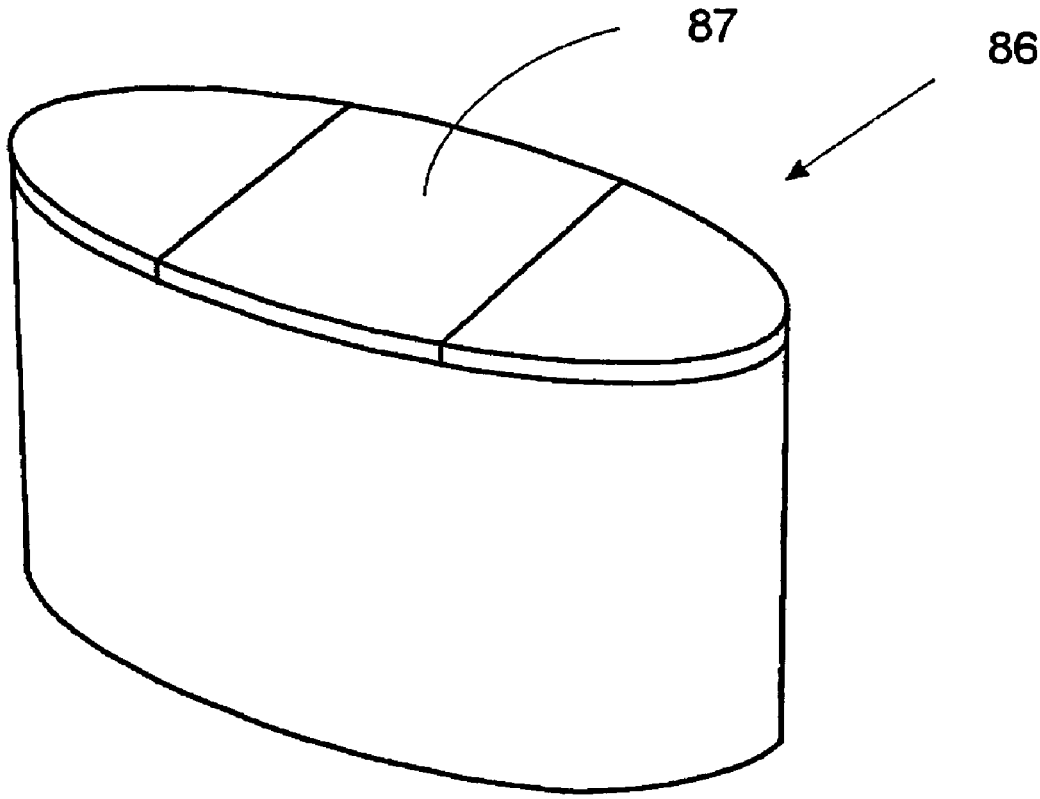
FIG. 50 is a perspective view of the polystyrene refrigerator illustrated in FIG. 49.
Figure 51:
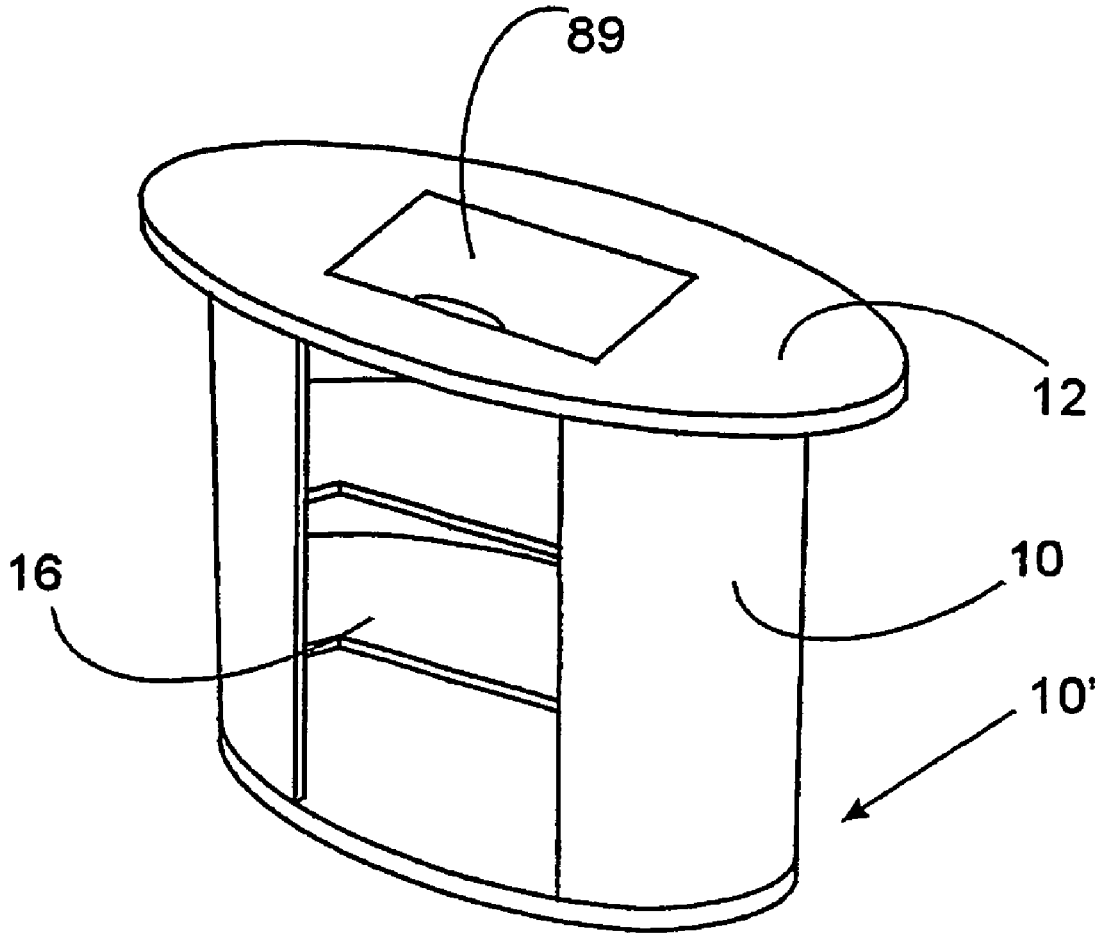
FIG. 51 is a perspective view of another mode of multiple exhibiting application comprising a universal module as that illustrated in FIG. 1, wherein the lid or cover has a gate to introduce envelopes or any other object in a box which is in the internal space of the universal module.
Figure 52:
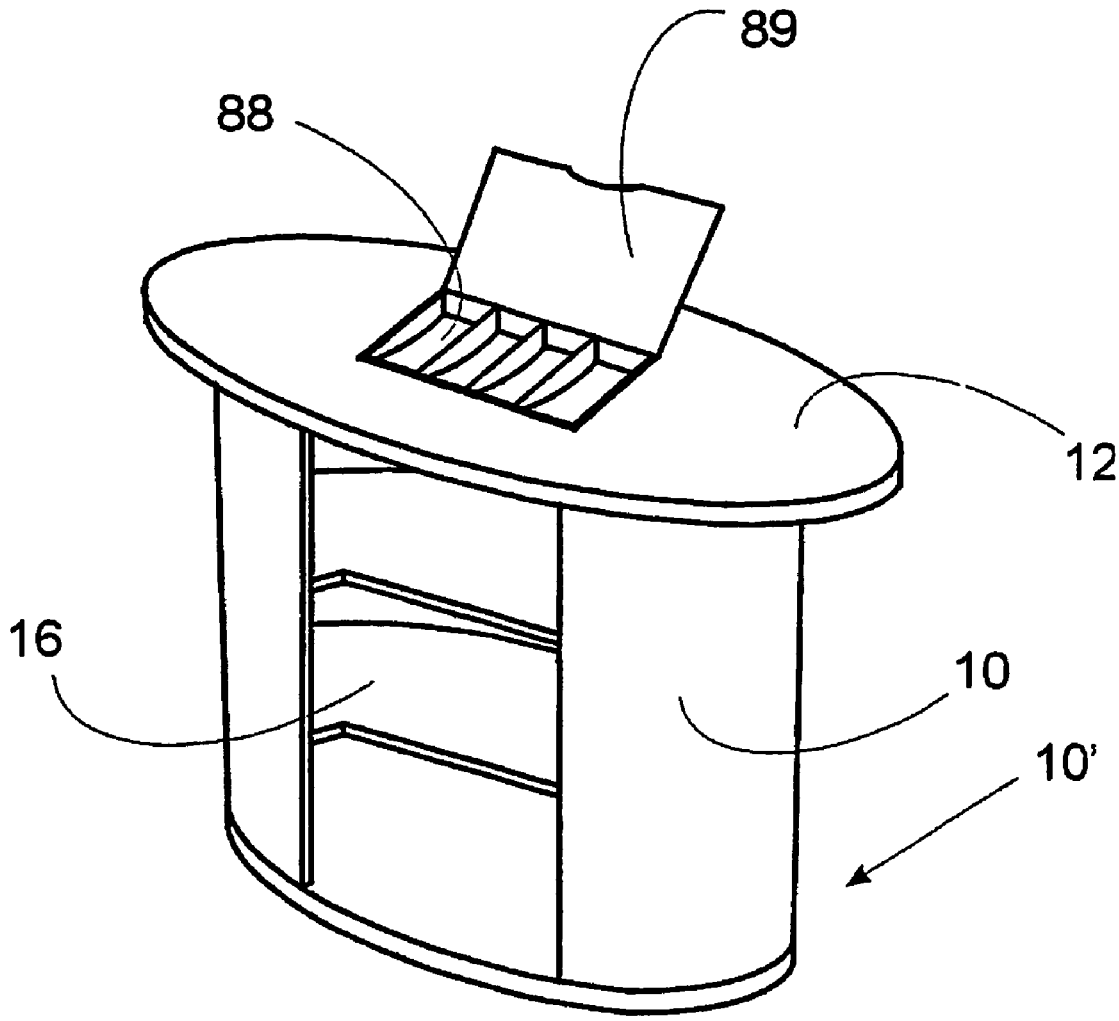
FIG. 52 is a perspective view of the multiple exhibiting application illustrated in FIG. 51, wherein it can be appreciated more clearly the internal arrangement of the elements integrating said multiple exhibiting application.

Other multiple exhibiting applications making part of the system of the present invention comprise the modification of the storage space of the above described universal module 10'. Thus, in a preferred mode illustrated in FIGS. 49 and 50, the multiple exhibiting application comprises a universal module 10' in which internal storage space it has been installed a polystyrene refrigerator 86 illustrated on FIG. 50, of cross section in general elliptic way, and having an access door 87. In other preferred mode illustrated in FIGS. 51 and 52, the multiple exhibiting application comprises a universal module 10' in which lid or cover 12 has a gate 89 allowing to introduce inside the module tickets, envelopes or any other object inside a box 88 which is located on a flange of the opening of the gate 89 of the lid or cover 12 of the universal module 10'.

Several modifications may be done regarding the structural arrangement described in specific way previously, without departing from the scope and spirit of the present invention, which is defined by the following claims.

The invention claimed is:

1. A module for a dismountable exhibition or customer assistance system, the module characterized by comprising a base board (14), a cover lid (12), and a laminar partition wall (30) forming a vertically extending cylindrical body of at least partially elliptical cross-section extending between the base board and the cover lid; wherein the laminar partition wall (30) comprises a series of elongated wood elements (33) of regular trapezoidal cross section, arranged in side to side relation and extending vertically in use, the wood elements (33) being flexibly joined by attaching the wider of the parallel faces of the wood elements (33) to a layer of textile material (29); wherein the undersurface of said cover lid (12) has a ledge (20), and the upper surface of said base board (14) has a raised central area (32'), which has an at least partially elliptical outwardly-facing surface perpendicular to the plane of the cover lid or base board, respectively; and wherein said outwardly facing surface is provided with one part of a hook and loop type fastener (31), the other part of the hook and loop type fastener being provided as bands (32) arranged along the upper and the lower edges, respectively, of the laminar partition wall (30).

2. A module according to claim 1, wherein the undersurface of said cover lid has a ledge and the upper surface of said base board has a raised central area, which has an elliptical outwardly facing surface perpendicular to the plane of the base board.

3. A module according to claim 1, further including one or more internal shelves (16), which are fixedly joined to the internal surface of the partition wall by means of a hook and loop type fastener strip, one part (31') of which is attached around the external edge of the shelf, and the other part (32) of which is fixed around the internal curved surface of the partition wall (30) of the module.

4. A module according to claim 1, further including a door (8) installed by conventional means in a door opening formed between side edges of the partition wall (30) and giving access to the internal space of the module.

5. A module according to any preceding claim, wherein the cover lid is elliptical or rectangular in shape.

6. A module according to claim 5, wherein the cover lid is essentially flat, or is modified to receive multiple exhibiting applications.

7. A module according to any of claims 1 to 4, wherein the cover lid is configured to include at least one of a reception tray for objects, a structure such as a coat rack to hang clothing, an opening to receive envelopes or similar objects, an upper access door mounted on at least one hinge, one or more socket openings configured to receive a parasol or a mast for carrying an advertisement, an advertisement pennant or similar objects, or one or more openings intended to receive cabling for electronic equipment.

8. A module for a dismountable exhibition or customer assistance system, the module characterized by comprising a base board, a cover lid, and a laminar partition wall forming a vertically extending cylindrical body of at least partially elliptical cross-section extending between the base board and the cover lid; which is a connection module adapted to allow the union of two, three or more elliptical modules according to any of claims 1 to 4, and whose laminar partition wall is of lesser height than the modules to be connected.

9. A module according to claim 8, wherein the connection module is a straight or curved connecting module (17), said connection module having a cover lid (18) in elongated form that may be straight or arcuate and a base board (18') corresponding in shape to the cover lid (18), the cover lid (18) and base board (18') each being formed with two concave recesses following the same curvature as the partition wall of an elliptical module.

10. A dismountable exhibition or customer assistance station system comprising one or more modules, said modules characterized by comprising a base board (14), a cover lid (12), and a laminar partition wall (30) forming a vertically extending cylindrical body of at least partially elliptical cross-section extending between the base board and the cover lid, and one or more connection modules (17) according to claim 9.

11. A dismountable exhibition or customer assistance station system according to claim 10, which is arranged in a circular formation.

12. A dismountable exhibition or customer assistance station according to claim 10, which is arranged in a straight line.

13. A dismountable exhibition or customer assistance station according to claim 10, which is arranged in a rectangular or oval formation.

14. A module according to claim 8, wherein the connection module is adapted to allow the union of three modules, and has a cover lid (42) in substantially triangular form with concave recesses at its vertices following the same curvature as the partition wall of an elliptical module, and a base board (43) corresponding in shape to the cover lid (42).

15. A dismountable exhibition or customer assistance station system comprising three or more modules, said modules characterized by comprising a base board (14), a cover lid (12), and a laminar partition wall (30) forming a vertically extending cylindrical body of at least partially elliptical cross-section extending between the base board and the cover lid; connected by one or more connection modules (17) according to claim 14, said modules arranged in one or more "Y" formations.

16. A dismountable exhibition or customer assistance station system according to any of claims 10, 11, 12, 13, or 15, wherein the partition walls of the connection modules have a vertical hook and loop type fastener strip at their side edges, which allows the detachable union of connector modules to the textile cloth which is in the exterior surface of the partition walls of elliptical modules.

17. A dismountable exhibition or customer assistance station system comprising an elliptical module according to any of claims 1 to 4 and an ear module (11'), the ear module comprising a base board (14), a cover lid (9, 9'), and a laminar partition wall (11) forming a vertically-extending cylindrical body of at least partially elliptical cross-section extending between the base board and the cover lid; the height of the partition wall of the ear module being less than the height of the partition wall of the elliptical module; and the cover lid and base board of the ear module being shaped at one end (7, 6') with a recess to correspond to the external shape of the partition wall of the elliptical module.

18. A dismountable exhibition or customer assistance station system according to claim 17, wherein the base board of said ear module is formed by flat, rigid narrow elements which are fixedly attached to extend along the inferior edge of said partition wall, and a rigid bottom partition wall with its side edge area, firmly supported on the upper surface of said flat, rigid, narrow elements.

19. A dismountable exhibition or customer assistance station system according to claim 18, wherein the upper edge of the vertical partition wall of the ear module is attached to the cover lid along the internal edge of a margin area that extends between the upper edge of said vertical partition wall and the exterior side edge of said cover lid.

20. A dismountable exhibition or customer assistance station system according to claims 18 or 19 wherein the cover lid (9') of the ear module has a generally square shape, one of the sides being formed with a recess configured to be adapted to the end curvature of the partition wall of an elliptical module.

21. A dismountable exhibition or customer assistance station system according to claim 20 comprising an elliptical module and a plurality of ear modules (11') arranged on a row extending from the elliptical module, wherein the heights of the ear modules (11') diminish as their position in said row is more remote from the elliptical module.

22. A dismountable exhibition or customer assistance station system according to claim 21 comprising an elliptical module, a number of ear modules (11') arranged to extend in a first direction from the elliptical module, and a number of ear modules (11') arranged to extend in a second direction, opposite to said first direction from the elliptical module, and wherein the heights of the ear modules (11') diminish as their positions are more remote from the elliptical module.

23. A dismountable exhibition or customer assistance station system according to claim 22, wherein the side edges of the partition walls (11) of the ear modules have a vertical hook and loop type fastener strip at their side edges, which allows the detachable union of ear modules to the textile cloth which is on the exterior surface of the partition walls of elliptical modules.

24. A module for a dismountable exhibition or customer assistance station system according to any of claims 1 to 4, wherein the cover lid, and base board or partition wall includes one or more indicator marks to assist alignment of the parts of the module during assembly.

25. A module for a dismountable exhibition or customer assistance station system according to any of claims 1 to 4, further comprising an upper structure mountable to the cover lid, the upper structure comprising a frontal panel, a posterior panel, one or both of which are of transparent material, and two side panels, the upper structure further including one or more light sources in the internal space formed by the frontal, posterior and side panels which permit the illumination of an advertisement or similar object placed on one of the posterior and frontal panels.

26. A module according to claim 25, wherein the front panel and the posterior panel are square or trapezoidal in form, and the side panels are triangular and are supported by the frontal and posterior panels.

27. A module according to claim 26, wherein the posterior and frontal panels have a textile cloth specially adapted to receive exhibition items.

28. A module according to claims 26 or 27, wherein the posterior and frontal panels have shelves located at determined distances to be able to support CD's, books or similar objects.

29. A module according to claim 28, wherein the posterior, frontal and side panels have shelves totally surrounding the upper structure.

30. A module according to claim 29, having an upper structure comprising one or more perforated or non-perforated trays.

31. A module according to claim 25, having an upper structure comprising a central panel fitted in central vertical grooves of two side panels forming an "H" shape structure in plan view, and a plurality of shelves fitted in grooves arranged in the inner faces of the side panels to form a series of racks, the side panels also having a plurality of shelves on their outer faces.

* * * * *